US006340219B1

(12) United States Patent
Kumagai et al.

(10) Patent No.: US 6,340,219 B1
(45) Date of Patent: Jan. 22, 2002

(54) INK JET RECORDING APPARATUS

(75) Inventors: Toshio Kumagai; Yoshiharu Aruga, both of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/541,006

(22) Filed: Mar. 31, 2000

(30) Foreign Application Priority Data

| | | |
|---|---|---|
| Mar. 31, 1999 | (JP) | 11-094058 |
| Mar. 31, 2000 | (JP) | 2000-096375 |
| Mar. 31, 2000 | (JP) | 2000-096418 |
| Mar. 31, 2000 | (JP) | 2000-096456 |
| Mar. 31, 2000 | (JP) | 2000-096483 |

(51) Int. Cl.[7] ..... B41J 2/165
(52) U.S. Cl. ..... 347/33; 15/247; 15/246
(58) Field of Search ..... 347/33; 15/250.361, 15/246, 256.5, 256.53, 250.23, 250.29

(56) References Cited

U.S. PATENT DOCUMENTS

| | | | | |
|---|---|---|---|---|
| 5,548,310 A | | 8/1996 | Binnert et al. | 347/33 |
| 6,168,268 B1 | * | 1/2001 | Sugiyama | 347/89 |

FOREIGN PATENT DOCUMENTS

| | | | | |
|---|---|---|---|---|
| EP | 0 314 513 A3 | | 5/1989 | B41J/3/04 |
| EP | 0 314 513 A2 | | 5/1989 | B41J/3/04 |
| EP | 0410691 | * | 1/1991 | |
| EP | 0 604 068 A3 | | 6/1994 | B41J/2/165 |
| EP | 0 604 068 A2 | | 6/1994 | B41J/2/165 |
| EP | 0 732 211 A1 | | 9/1996 | B41J/2/165 |
| EP | 0 841 168 A2 | | 5/1998 | B41J/2/165 |
| EP | 0 841 168 A3 | | 4/1999 | B41J/2/165 |
| GB | 2311 041 A | | 9/1997 | B41J/2/165 |
| JP | 7-132615 | | 5/1995 | B41J/2/175 |
| JP | 11-254707 | * | 1/1999 | |

* cited by examiner

*Primary Examiner*—John Barlow
*Assistant Examiner*—Ly T Tran
(74) *Attorney, Agent, or Firm*—Sughrue Mion, PLLC

(57) ABSTRACT

A wiping unit for wiping a nozzle formation face of a recording head of an ink jet recording apparatus includes a slider reciprocally moving in a direction parallel with the nozzle formation face. A wiper is supported by the slider. One end of the wiper is pressed against the nozzle formation face as a wiping operation when the slider moves in a first direction, while as a rubbing operation when the slider moves in a second direction opposed to the first direction. A supporter rotatably supports the other end of the wiper on the slider. A spring urges the wiper toward the nozzle formation face while keeping an attitude of the wiper directed by a reaction force generated when the wiping operation is executed. A rotation limitter restricts the rotation of the wiper such that the wiper is rigidly supported by the slider when the rubbing operation is executed.

25 Claims, 34 Drawing Sheets

INK JET RECORDING APPARATUS

BACKGROUND OF THE INVENTION

This invention relates to an ink jet recording apparatus comprising a head maintenance unit for maintaining the jetting characteristic of a recording head.

An ink jet recording apparatus comprises: a recording head mounted on a carriage reciprocating in a main scanning direction; and recording medium feeder for feeding a recording medium such as a recording sheet intermittently a predetermined amount in a subscanning direction at one time for jetting ink drops from the recording head to the opposed recording medium for recording while moving the recording head in the main scanning direction.

A monochrome ink jet recording apparatus normally is equipped with one recording head. A full-color ink jet recording apparatus is equipped with a black ink recording head for jetting black ink and color recording heads for jetting color inks of yellow, cyan, magenta, etc. Such a configuration is disclosed in Japanese Patent Publication No. 7-132615A, for example.

The principle of jetting ink from each recording head of the ink jet recording apparatus is as follows: As well known, ink is pressurized by a predetermined pressure in a pressure generating chamber and based on the pressure, ink is jetted as an ink drop of controlled size to the recording medium from each nozzle orifice in a nozzle formation face. Therefore, the ink jetting characteristic from each nozzle orifice of the recording head needs to be maintained constant and if the ink jetting characteristic varies, degradation of the record quality results.

The ink jetting characteristic of the recording head varies because of a rise in viscosity caused by evaporation and drying of ink in the nozzle orifices, ink hardening, clogging, deposition of dust, mixing of air bubbles, etc. Thus, the ink jet recording apparatus is provided with a head maintenance unit for excluding the variation causes of the ink jetting characteristic to maintain the ink jetting characteristic of the recording head constant for maintaining the jetting characteristic of the recording head.

First, the head maintenance unit comprises a capping unit. At the non-recording time, the capping unit seals the nozzle formation face for isolating the nozzle orifices from the outside, thereby suppressing drying of ink and arise in ink viscosity.

If the capping unit seals the nozzle formation face, clogging the nozzle orifices, mixing air bubbles into an ink flow passage, etc., cannot completely be prevented. Then; second the head maintenance unit comprises a suction pump capable of forcibly sucking and discharging ink from the nozzle orifices to remove clogging of the nozzle orifice and the mixed air bubbles. With the suction pump, negative pressure is made to act on the nozzle orifices in a state in which the capping unit seals the nozzle formation face, and ink is forcibly sucked and discharged from the nozzle orifices for removing the clogging, the mixed air bubbles, etc. Normally, the forcible ink sucking and discharging processing with the suction pump is executed when the record operation is restarted after the recorder halts for a long time or the user, who recognizes degradation of the record image quality, operates a dedicated switch on an operation panel.

If the forcible ink sucking and discharging processing with the suction pump is executed as described above, ink may be scattered and deposited on the nozzle formation face of the recording head and a meniscus of ink in each nozzle orifice is disordered. A foreign substance easily adheres to the nozzle orifices of the recording head over time. Then, third the head maintenance unit comprises a wiper for wiping the nozzle formation face as required.

The wiper has a plate-like wiping member made of a composite material comprising a wiping material made of an elastic plate of rubber, etc., on one side and a rubbing member having the same shape as the wiping material, made of felt, etc., on an opposite side and a holder for pinching and supporting the base end side of the wiping member. While the margin of the tip side of the wiping member is pressed elastically against the nozzle formation face, the wiping member is relatively reciprocated for cleaning the nozzle formation face. For example, the wiping material is pressed against the nozzle formation face at the forth or back motion time, and the rubbing material is pressed against the nozzle formation face at the back or forth motion time, thereby cleaning the nozzle formation face.

The cleaning operation with the wiping material of the wiping member is called "wiping operation." The "wiping operation" takes an important role of uniforming, namely, stabilizing a meniscus of ink in each nozzle orifice in addition to wiping ink deposited on the nozzle formation face. Thus, the force of elastically pressing the margin of the wiping material against the nozzle formation face must be set to a soft and appropriate strength to such an extent that the meniscus can be stabilized reliably; this is a first technical demand.

The cleaning operation with the rubbing member of the wiper is called "rubbing operation." The "rubbing operation" has a role of scraping off a foreign substance fixedly secured to the nozzle formation face. Thus, the force of pressing the margin of the rubbing material against the nozzle formation face must be set large to such an extent that the foreign substance fixedly secured to the nozzle formation face can be scraped off; this is a second technical demand.

However, hitherto, to meet the first and second technical demands for the wiper, a wiping member easily bent and a rubbing member harder to bend than the wiping member have been used only in combination. Thus, naturally there is a limit and both the technical demands are not easy to meet sufficiently.

SUMMARY OF THE INVENTION

It is therefore an object of the invention to provide an ink jet recording apparatus which has a head maintenance unit for maintaining the jetting characteristic of a recording head and can easily and sufficiently meet the first and second technical demands for the wiping member of the wiper, one of the head maintenance units.

To the end, according to a first aspect of the invention, there is provided an ink jet recording apparatus comprising:

a recording head; and a wiping unit for wiping a nozzle formation face of the recording head including:

- a slider reciprocally moving in a direction parallel with the nozzle formation face;
- a wiper supported by the slider, one end of which is pressed against the nozzle formation face as a wiping operation when the slider moves in a first direction, while as a rubbing operation when the slider moves in a second direction opposed to the first direction;
- a supporter for rotatably supporting the other end of the wiper on the slider;

a spring for urging the wiper toward the nozzle formation face while keeping an attitude of the wiper directed by a reaction force generated when the wiping operation is executed; and a rotation limitter for restricting the rotation of the wiper such that the wiper is rigidly supported by the slider when the rubbing operation is executed.

According to the configuration, during the wiping operation, the wiper is pressed against the nozzle formation face of the recording head using the elastic forces of both the wiper itself and the spring, so that the first technical demand that the wiper must be pressed against the nozzle formation face with a soft and appropriate strength to such an extent that a meniscus of ink in the nozzle orifice can be stabilized reliably as compared with the structure in the related art wherein the wiper is pressed by the elastic force of only the wiper itself can be met easily and sufficiently.

During the rubbing operation, the rotation limitter restricts rotation of the wiper for placing the wiper in a rigid support state, so that the wiper is strongly pressed against the nozzle formation face and thus the foreign substances fixedly secured to the nozzle formation face can be scraped off reliably; the second technical demand can be met easily and sufficiently.

Preferably, the wiper is composite member made of a wiping member which is an elastic plate and a rubbing member made of a material having a higher bending resistance than the wiping member.

According to the configuration, the wiping operation is performed with the wiping material appropriate for wiping and the rubbing operation is performed with the rubbing material appropriate for rubbing, so that the spring is also used, whereby the first and second technical demands can be met easily and sufficiently all the more.

Preferably, the wiping unit includes:

a holder for holding the other end of the wiper and rotatably supported by the slider through the supporter; and an arm member one end of which supports the holder, and the other end of which is-engaged with the slider with a play of a predetermined stroke for absorbing the elastic force of the spring.

According to the configuration, the first technical demand can be met as a simple structures.

Preferably, the slider has a shaft member fitted into a slot formed at the other end of the arm member so as to be movable within the slot. The movable range of the shaft member corresponds to the play.

According to the configuration, the play of the predetermined stroke is provided in the movable range of the slot relative to the shaft body, namely, the spring action range is limited, so that the urging force of the spring can be used stably with a predetermined strength.

Preferably, the rotation limitter holds the wiper at one rotational limit position to execute the rubbing operation.

According to the configuration, when the wiper is at one rotational limit position, the rubbing operation is performed, so that the wiper cannot be rotated during the rubbing operation and thus a strong press strength can be provided according to a mechanically simple structure.

Preferably, the slider includes:

a main rack extending in a longitudinal direction of the slider; and a pinion meshed with the main rack and rotating back and forth to reciprocally moving the slider.

According to the configuration, the slider is reciprocated by the rack-pinion mechanism, so that the stability of reciprocating the slider can be enhanced as a simple structure.

Preferably, the slider indudes a differential rack extending parallel with the main rack and having a first portion and a second portion. The pinion meshes both of the main rack and the differential rack in the first portion to move the slider cooperationally. The pinion meshes only the differential rack in the second portion to reciprocally tilting the wiper.

According to another aspect of the invention, the ink jet recording apparatus further indudes a differential rack being placed slidably in the longitudinal direction of the slider, wherein the differential rack is reciprocated in step with the main rack by rotating a pinion meshing with the differential rack in forward and backward directions and wherein at the move termination part of the slider in the forth motion direction, only the differential rack is further pushed out by the pinion and is moved in the forth motion direction, whereby the wiper is tilted in the forth motion direction.

Preferably, pitches of the main rack and the differential rack are substantially the same. The number of teeth of the differential rack is larger than the number of teeth of the main rack.

According to the configurations, the differential rack enables the wiper to be easily tilted in the forth motion direction after the termination of the wiping operation, whereby the wiper can be restored to the former position without bringing the wiper into contact with the nozzle formation face of the recording head after the termination of the wiping operation.

Preferably, the wiping unit includes:

a holder for holding the other end of the wiper and rotatably supported by the slider through the supporter; and an arm member one end of which supports the holder, and the other end of which is engaged with the slider with a play of a predetermined stroke for absorbing the elastic force of the spring.

According to the configuration, the first technical demand can also be met as a simple structure in the structure using the differential rack.

Preferably, the slider has a member fitted into a slot formed at the other end of the arm member so as to be movable within the slot. The movable range of the shaft member corresponds to the play.

According to the configuration, the play of the predetermined stroke is also provided in the movable range of the slot relative to the shaft body in the structure using the differential rack, so that the urging force of the spring can be used stably.

Preferably, the rotation limitter is established by meshing the pinion with the differential rack.

According to the configuration, the differential rack and the main rack are moved in one piece by the pinion in the state in which the pinion, the differential rack, and the main rack mesh with each other at the same time, so that the wiper is restricted in rotation in the forth motion direction. Therefore, the strong press strength during the rubbing operation can also be provided as a simple structure in the structure using the differential rack.

Preferably, the ink jet recording apparatus further comprises an ink remover for removing ink adhered onto the wiper after the wiping operation has been executed. A front face of the ink remover is formed such that the wiper is brought into contact therewith gradually when the slider is moved toward the first direction. A rear face of the ink remover is formed such that a force for elastically bending the wiper applied by the front face is released and thereby the wiper is restored rapidly.

According to the configuration, ink is removed from the wiper by the ink remover, so that the capability of the wiper can be easily recovered. Preferably, the recovery operation is performed for each wiping operation. Since the ink remover has the front of the shape to allow the wiper to gradually start to come in contact with, splashing of ink can be decreased if the wiper with ink strikes the ink remover. Further, the ink remover has the rear of the shape to allow the wiper to be detached in a stroke after the wiper is bent in an opposite direction to the move direction as it is pressed against the front of the ink remover, so that ink can be splashed from the wiper at the instant at which the wiper is detached, and the capability of the wiper can be recovered reliably.

The front shape of the ink remover may be a slope, a face having a large number of asperities, a face formed with an opening at a position opposed to the end margin of the wiper, etc., for example.

Preferably, the ink jet recording apparatus further comprises an ink absorber for receiving ink removed and splashed from the wiper by the ink remover.

According to the configuration, the ink splashed instantaneously from the wiper can be reliably caught without being leaked to other parts.

Preferably, the ink jet recording apparatus further comprises:

a capping unit having a capping state in which the capping unit moves toward the recording head to seal the nozzle formation face and a non-capping state in which the capping unit moves away from the recording head to release the sealing of the nozzle formation face; and a unit frame for retaining the wiping unit and the capping unit.

The wiping unit reciprocally moves in a space defined between the recording head and the capping unit in the non-capping state.

According to the configuration, the wiper is reciprocated in the space in the non-capping state of the capping unit, so that the recorder can be made compact.

Preferably, the ink jet recording apparatus further comprises:

a cap drive cam for changing a rotational movement thereof into the reciprocal movement of the capping unit between the capping state and the non-capping state;

a main rack extending in a longitudinal direction of the slider;

a pinion meshed with the main rack and rotating back and forth to reciprocally moving the wiping unit;

a drive gear meshed with the pinion to rotate the same; and a shaft member for coaxially supporting the cap drive cam and the drive gear such that the reciprocal movements of the capping unit and the wiping unit are conducted at a predetermined timing.

According to the configuration, the drive gear for meshing with the pinion and rotating the pinion and the cap drive cam are placed on one support shaft member for timing reciprocal movement of the wiper and the capping unit, so that control can be simplified.

Preferably, the ink jet recording apparatus further comprises:

a subframe engaged with a part of the unit frame in a cantilevered manner; and a cam follower, which is to be abutted against the cap drive cam, attached to the subframe.

The capping unit is disposed in a free end side of the subframe.

According to the configuration, the reciprocal movement of the capping unit can be performed by simple cam control.

Preferably, ink jet recording apparatus further comprises a valve drive cam supported by the shaft member coaxially with the drive gear and the cap drive cam. The capping unit includes:

a valve member for opening and dosing an internal space of the capping unit; and an operator for operating the open/close state of the valve member, which is operated by the valve drive cam.

According to the configuration, the valve member for opening and closing the internal space of the capping unit can be opened and closed as a simple structure by simple cam control.

Preferably, ink jet recording apparatus further comprises a suction pump for applying negative pressure in the internal space of the capping unit, and provided in the unit frame to constitute a head cleaning unit together with the wiping unit and the capping unit.

According to the configuration, the suction pump, the wiper, and the capping unit make up the head cleaning unit in one piece, so that the head cleaning unit can be made compact and can be easily assembled.

Preferably, the wiping unit includes a plurality of units arranged parallel with each other, each composed of a pair of slider and a wiper. The recording apparatus further comprises a selector for selecting one out of all available combinations of the wiping units to be driven.

According to the configuration, the ink jet recording apparatus comprises the selector capable of selecting the wiping units to be driven, so that both or either of the wiping operation and the rubbing operation can be executed only for the nozzle array requiring both or either of the wiping operation and the rubbing operation; the efficient operation with no waste can be performed.

Preferably, the ink jet recording apparatus further comprises a select cam supported by the shaft member coaxially with the drive gear, the cap drive cam and the valve drive cam. The selector is cooperated with the select cam to execute the selecting operation when the select cam is moved in a first direction which is opposed to a second direction in which the cap drive cam and the valve drive cam operates the capping member and the valve member respectively. The shaft member is rotated in the second direction after the selecting operation has been conducted to drive the selected wiping unit.

According to the configuration, selecting a wiping unit and both or either of the wiping operation and the rubbing operation of the selected wiping unit can be easily accomplished by backward and forward rotating one cam support shaft.

Preferably, the moving direction of the slider is parallel with an extending direction of an nozzle array on the nozzle formation face.

According to the configuration, the wiper is moved in the subscanning direction rather than in the main scanning direction, so that it is less feared that ink may be scattered in the main scanning direction accompanying the wiping operation, and even with a recording apparatus adopting a multicolor head, it is less feared that color inks may be mixed by performing the wiping operation.

Preferably, the ink jet recording apparatus further comprises a passage through which a recording medium is transported to be subjected to the recording by the recording head, the passage extending obliquely from a top part of the apparatus to a bottom part of the apparatus. The moving direction of the slider is parallel with the passage and the first direction directs toward the end of the passage.

DETAILED DESCRIPTION OF THE PREFERRED EMBODIMENTS

Figure 1:
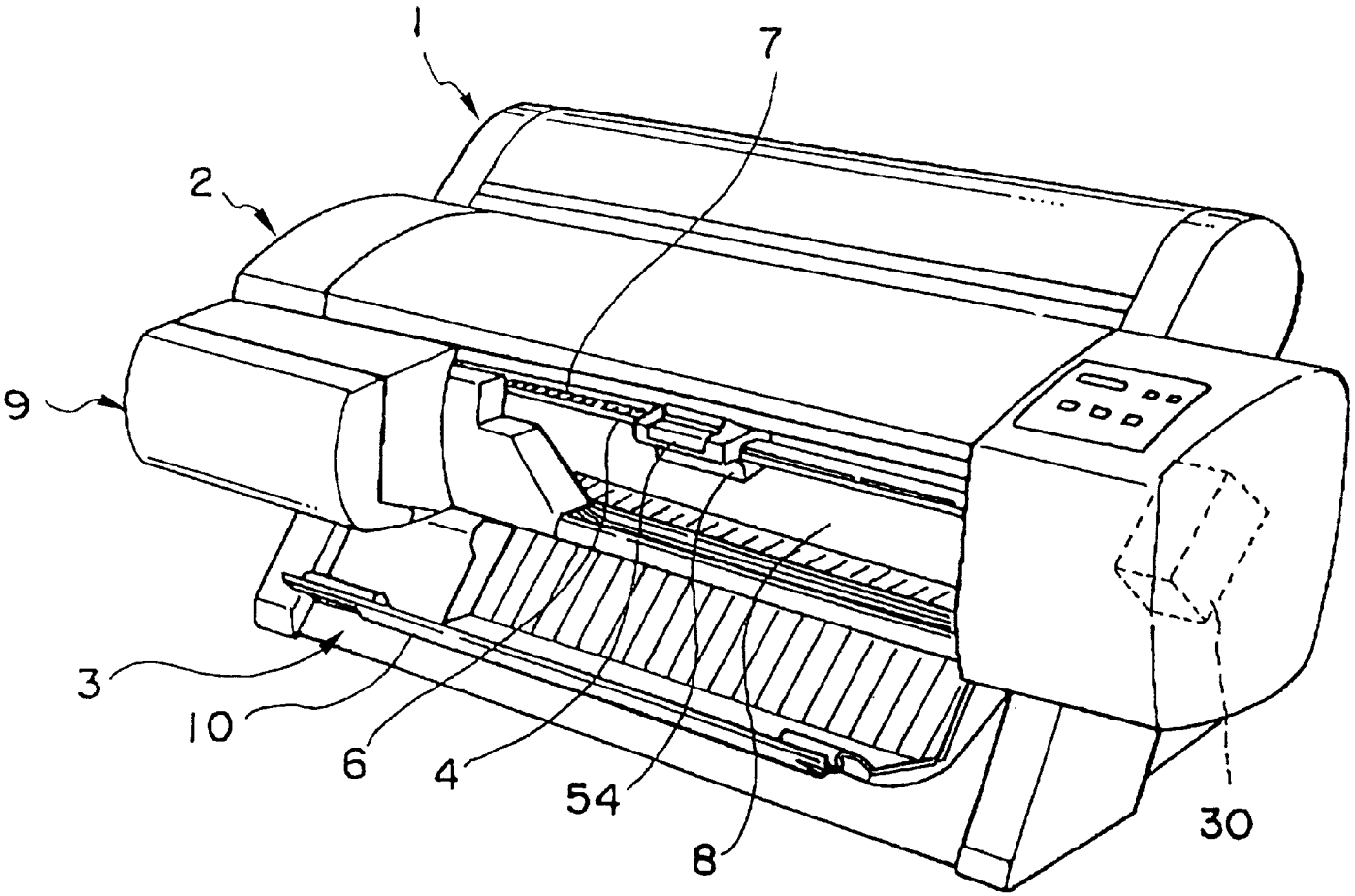
FIG. 1 is a perspective view to show an ink jet recording apparatus according to the invention.
Figure 2:
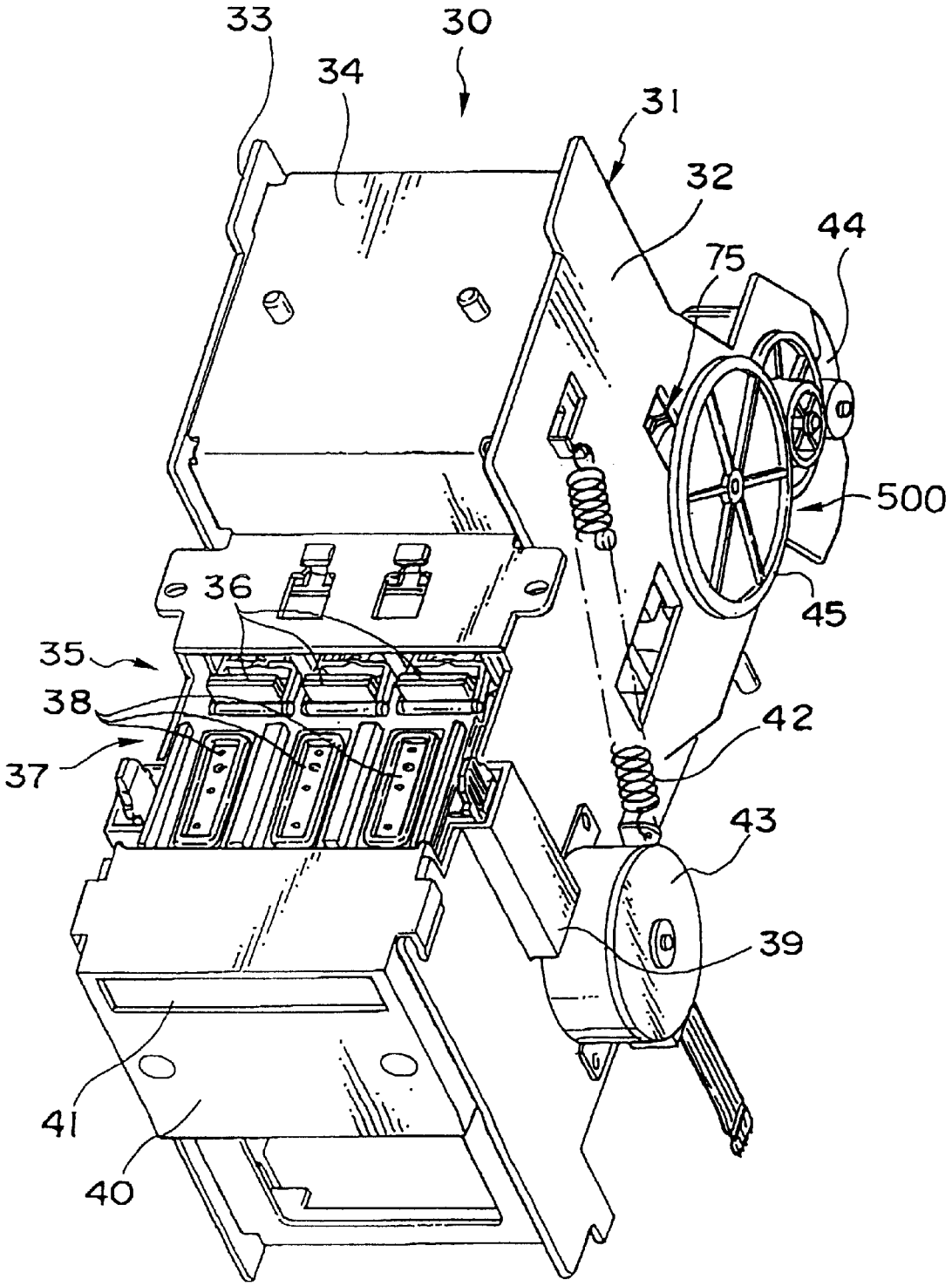
FIG. 2 is a perspective view to show a head maintenance unit according to the invention.
Figure 3:
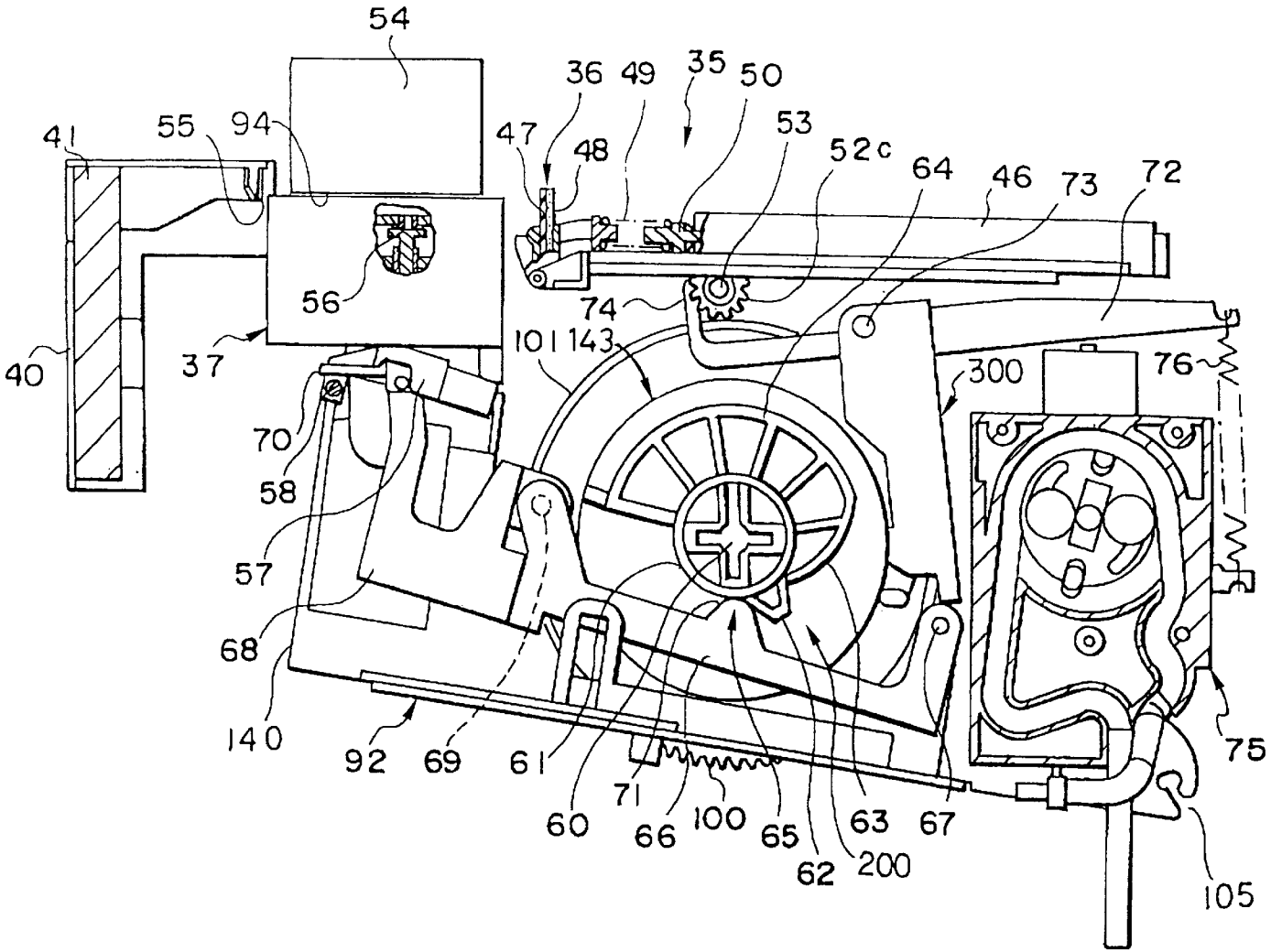
FIG. 3 is a schematic side view of the inside of the head maintenance unit with a partly sectioned view and shows a state in which a cam is at a reference position for a home position.
Figure 4:
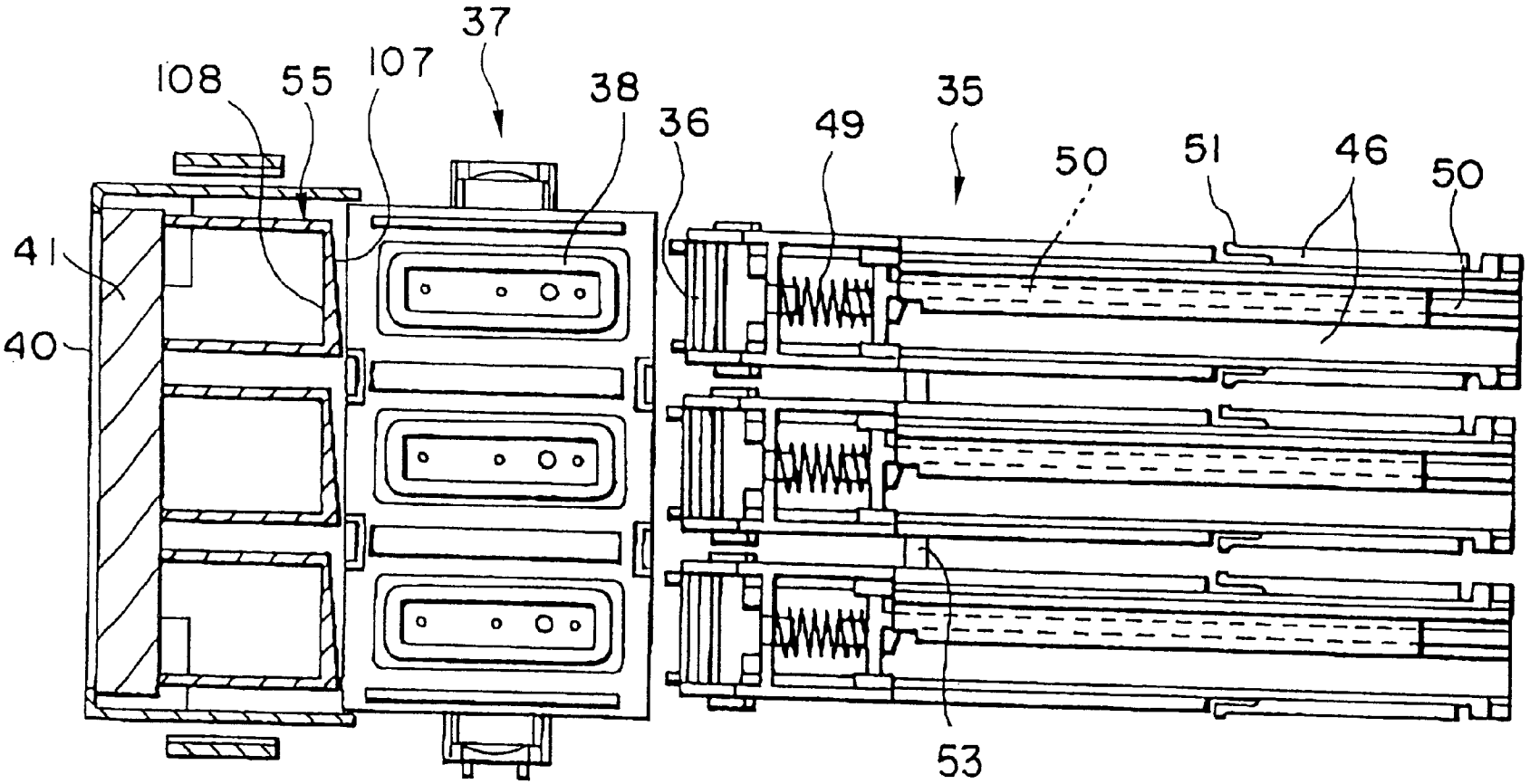
FIG. 4 is a schematic plan view of the inside of the head maintenance unit with a partly sectioned view.

Referring now to the accompanying drawings, there are shown preferred embodiments of the invention. FIG. 1 is a perspective view to show an ink jet recording apparatus according to the invention. FIG. 2 is a perspective view to show a head maintenance unit according to the invention. FIG. 3 is a schematic side view with a partly sectioned view of the inside of the head maintenance unit. FIG. 4 is a schematic plan view with a partly sectioned view of the inside of the head maintenance unit.

The ink jet recording apparatus is a largesized printer that can also print paper of a comparatively large size such as the paper width 594 mm (A1 in the JIS) or 728 mm (B1 in the JIS). Of course, the invention can be applied not only to such a large-sized printer, but also to a standard-sized printer.

As shown in FIG. 1, the ink jet recording apparatus comprises a paper feeder 1; a recording section 2, and a paper discharger 3 positioned from the top to the bottom front. Predetermined printing is executed on paper of a recording medium while the paper is sent from the pap feeder 1 to the recording section 2 to the paper discharger 3, and ten the paper is discharged to the outside. A paper transport passage 8 at the printing time is formed at an inclination angle of 65 degrees with respect to the horizontal plane. A nozzle formation face of a recording head 54 mounted on a carriage 4 and reciprocated in a main scanning direction along a guide shaft 6 is also disposed at an inclination angle of 65 degrees so as to become parallel with the paper transport passage 8. The invention is not limited to the recorder of such an inclination structure, of course.

A head maintenance unit 30 for maintaining the jetting characteristic of the recording head 54 is disposed in a portion including a home position of the carriage 4. When the carriage 4 is at the home position, the head maintenance unit 30 performs processing of maintaining the jetting characteristic of the recording head 54. In FIG. 1, numeral 7 denotes a driving belt for reciprocating the carriage 4 in the main scanning direction, numeral 9 denotes an ink cartridge holder, and numeral 10 denotes a front cover in an open state.

As shown in FIG. 2, the head maintenance unit 30 comprises a unit frame 31 made up of both side frames 32 and 33, an upper frame 34, etc., and shaped almost like a box. That is, the unit frame 31 contains a wiping unit 35 for wiping the nozzle formation face as required, a capping unit 37 pressed against the nozzle formation face of the recording head 54 at the non-recording time for sealing nozzle orifices, a drive mechanism section 200 for driving the wiping unit 35 and the capping unit 37, a suction pump 75 for forcibly sucking and discharging ink to remove clogging of the nozzle orifices and mixed air bubbles, an ink remover 55 not shown in FIG. 2 and shown in FIGS. 3 and 4, a selector 300 (FIG. 3); etc. The ink remover 55 is adapted to recover the capability of the wiping unit 35 and the selector 300 is adapted to allow the wiping operation, etc., to be performed only for a necessary nozzle array if a multicolor head is adopted.

A drive motor 43 for operating the capping unit 37 and a pump motor 44 for operating the suction pump 75 are attached to the side frame 32. Numeral 45 denotes a gear for transmitting power of the pump motor 44 to the suction pump 75.

The internal structure of the unit frame 31 will be discussed with reference to FIGS. 3 and 4. As shown here, the wiping unit 35, the capping unit 37, and the ink remover 66 are disposed in order. The direction in which they are disposed is a direction in which a slider 46 of the wiping unit 35 is reciprocated, and the ink remover 65 is disposed at the termination point of the forth motion. The reciprocating direction of the slider 46 in the embodiment is made slant so as to be compatible with a nozzle formation face 94; particularly the forth motion direction of the slider 46 is made parallel with the nozzle formation face 94 and is tilted downward.

Figure 21:
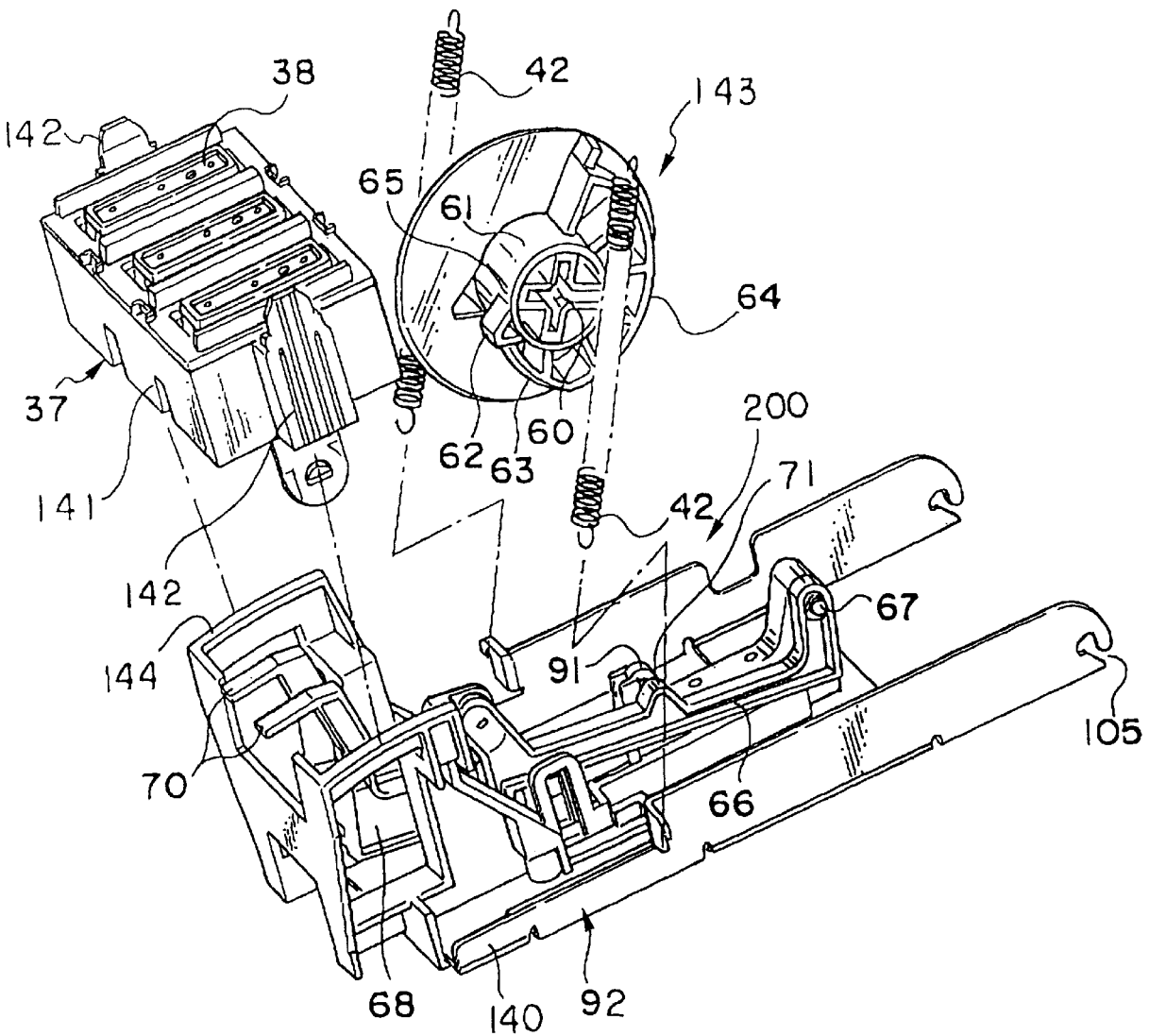
FIG. 21 is an exploded perspective view of the portion of a drive mechanism section and a capping unit according to the invention.

As shown in FIG. 3, the suction pump 75 and the drive mechanism section 200 are placed below the wiping unit 35. The roughly whole structure of the drive mechanism section 200 is shown in FIG. 21 as a perspective view in a disassembly state into large element units together with the capping unit 37. The drive mechanism section 200 uses the drive motor 43 as a power source for enabling the capping unit 37 to take a capping state in which the capping unit 37 goes to the side of the recording head 54 for sealing the nozzle formation face 94 (the state in FIG. 3) and a non-capping state in which the capping unit 37 retreats from the capping state for unsealing the nozzle formation face 94 (the state in FIGS. 11 and 12). Further, the drive mechanism section 200 opens and doses a valve 56 in the capping unit 37, reciprocates the slider 46 of the wiping unit 35, and controls the selection operation of the selector 300.

As shown in FIG. 4, in the embodiment, to handle a multicolor head, the wiping unit 35 comprises three wiping units each consisting of a pair of one wiper 36 and a slider 46 corresponding thereto. The three wiping units are disposed so that the sides of the wiping members 36 can be swung up and down with the base end side as a supporting point, and the side of each wiper 36 is urged downward by a plate spring (not shown) all the time. The wiping unit is pressed and retained by the plate spring at a constant position where a rack placed on the bottom face of the wiping unit (described later) meshes with a pinion supported on a pinion support frame 130 (described later), separate from the wiping unit. Three ink removers 55 are provided corresponding to the three wiping units and further three sealing caps 38 of the capping unit 37 are also provided.

Figure 5:
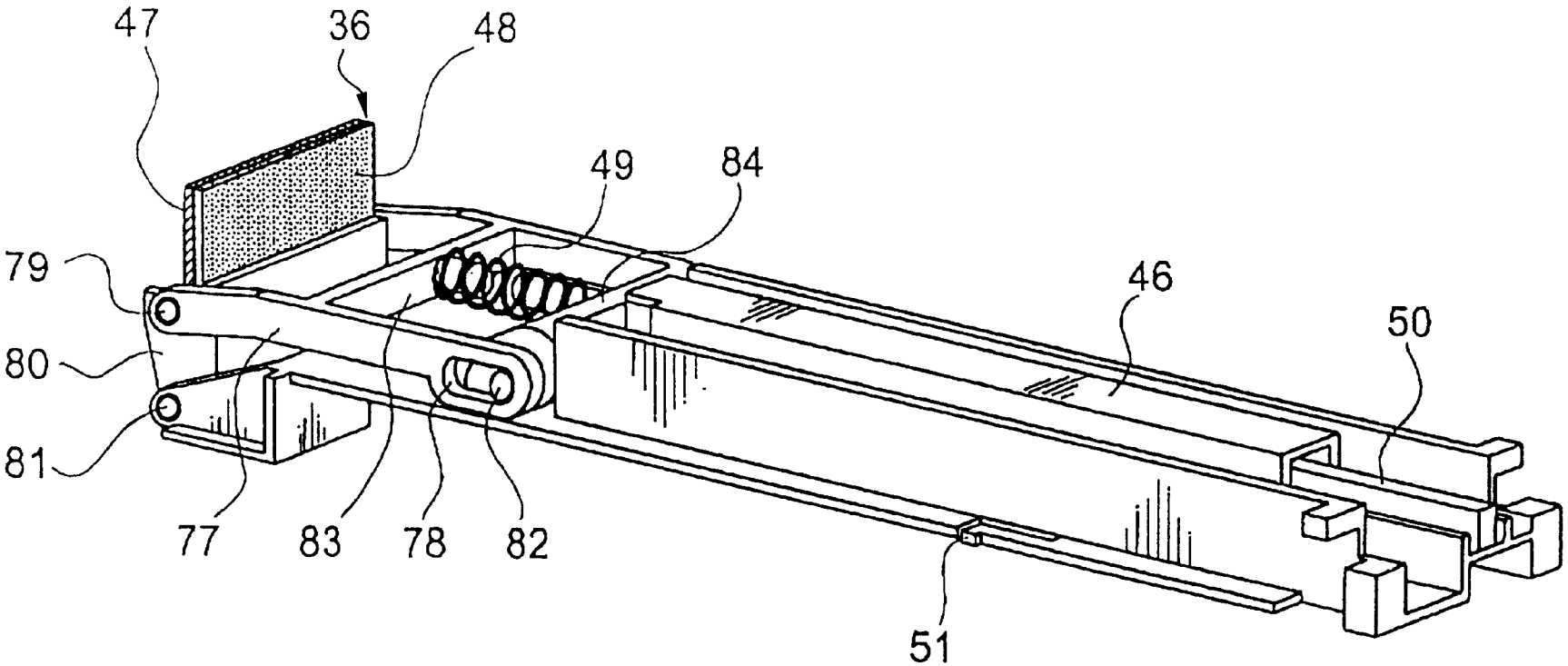
FIG. 5 is a perspective view of a wiping unit according to the invention to show that a wiping member is in a perpendicular state.

Next the structure of the wiping unit 35 will be discussed in detail with reference to FIGS. 5 to 8. FIG. 5 is a perspective view of the wiper according to the invention to show that the wiper 36 is supported in an orthogonal state to the reciprocating direction of the slider 46. The wiper 36 is made of a composite material provided by joining a wiping member 47 made of an elastic plate of rubber, etc., and a rubbing member 48 made of felt, etc., having larger resistance to bend than the wiping member 47. The base end side of the wiper 36 is strongly clamped by a holder 80 and is attached to a supporter 81 at the tip of the slider 46 via the holder 80 for rotation.

The free end side of the holder 80 is supported by an arm 77 and an opposite end part of the arm 77 is retained in a shaft body 82 of a separate body with play of a predetermined stroke. This retention structure is provided by loosely engaging a slot 78 made in the opposite end part of the arm 77 in the shaft body 82. Therefore, the arm 77 has the play of the predetermined stroke in the limited move range of the slot 78 relative to the shaft body 82, whereby the wiper 36 can be rotated in the range corresponding to the movable distance of the slot 78 relative to the shaft body 82.

If the shaft body 82 is fixed to the slider 46, the range in which the wiper 36 can be rotated is limited to the move range of the slot 78 relative to the shaft body 82. Specifically, the wiper 36 is mechanically restricted in rotation in the forth motion direction from the orthogonal state to the slider 46 shown in FIG. 5 and cannot be tilted, and this position becomes the rotation limit in the forth motion direction. This state is used in the rubbing operation described later.

A coil spring 49 is placed in a compression state between a base body 84 to which the shaft body 82 is fixed and a coupling part 83 of the left and right of the arm 77, and the wiper 36 receives the urging force of the coil spring 49 in the move range of the slot 78 relative to the shaft body 82, namely, the range in which the wiper 36 can be rotated. The strength of the coil spring 49 is set so that at the wiping operation time, the wiper 36 receiving the reaction involved in pressing the wiper 36 against the nozzle formation face 94 and rotated in the direction of the reaction is urged in the pressing direction in the state intact and is supported by both the elastic force of the wiper 36 itself and the elastic force of the coil spring 49.

In the embodiment, the base body 84 to which the shaft body 82 is fixed is not fixed to the slider 46 and is fixed to a base body 50 (FIG. 6) of a differential rack 86 that can be moved relatively to the slider 46. Therefore, the differential rack 86 can be moved with respect to the slider 46, so that the wiper 36 can be further moved in the forth motion direction of the slider 46. FIG. 7 shows a state in which the wiper 36 is rotated further largely exceeding the rotation range of the wiper 36 corresponding to the move range of the slot 78 relative to the shaft body 82. That is, the differential rack 86 is further moved with the slider 46 stopped, whereby the wiper 36 can be tilted largely in the forth motion direction.

Figure 6:
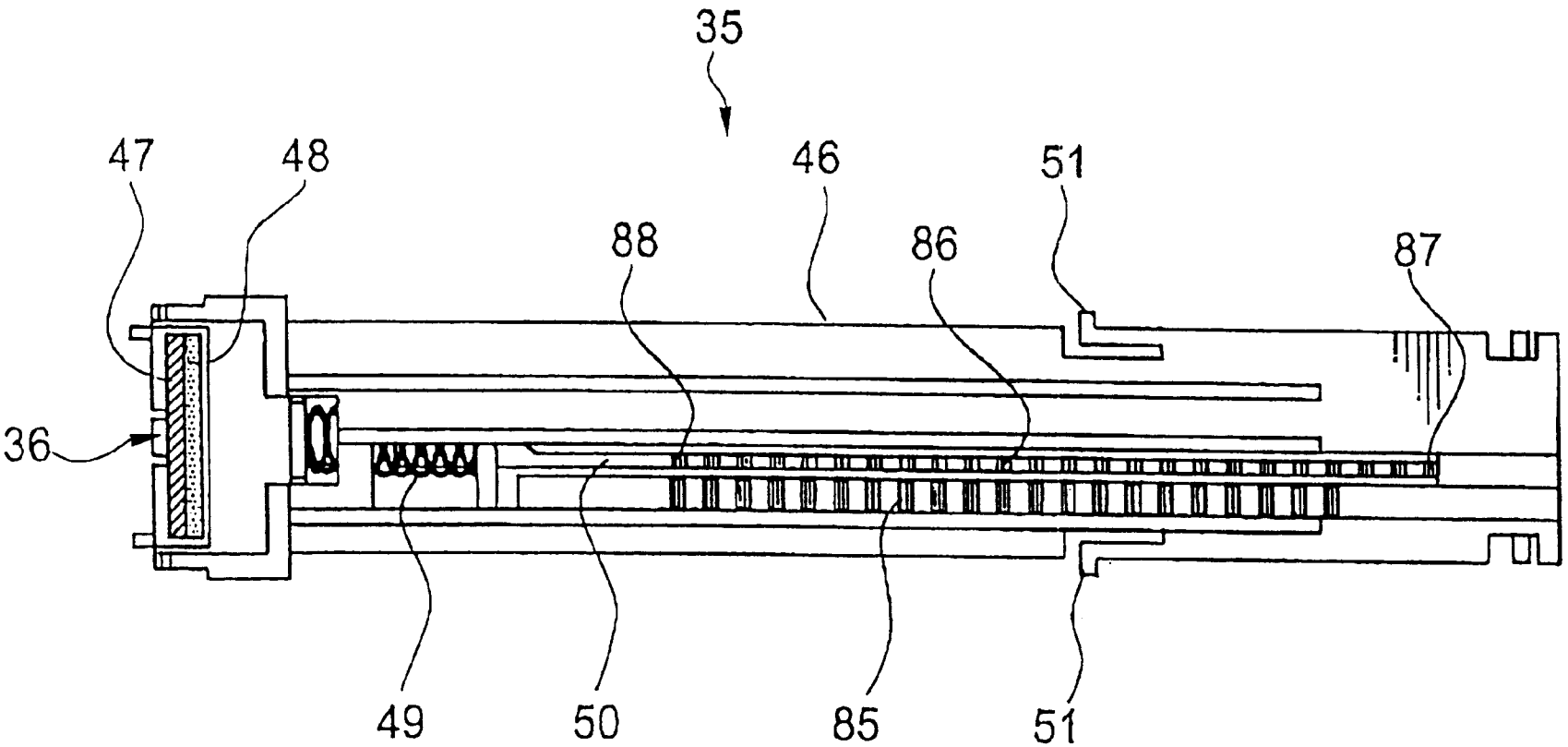
FIG. 6 is a bottom plan view of the wiping unit of FIG. 5.
Figure 7:
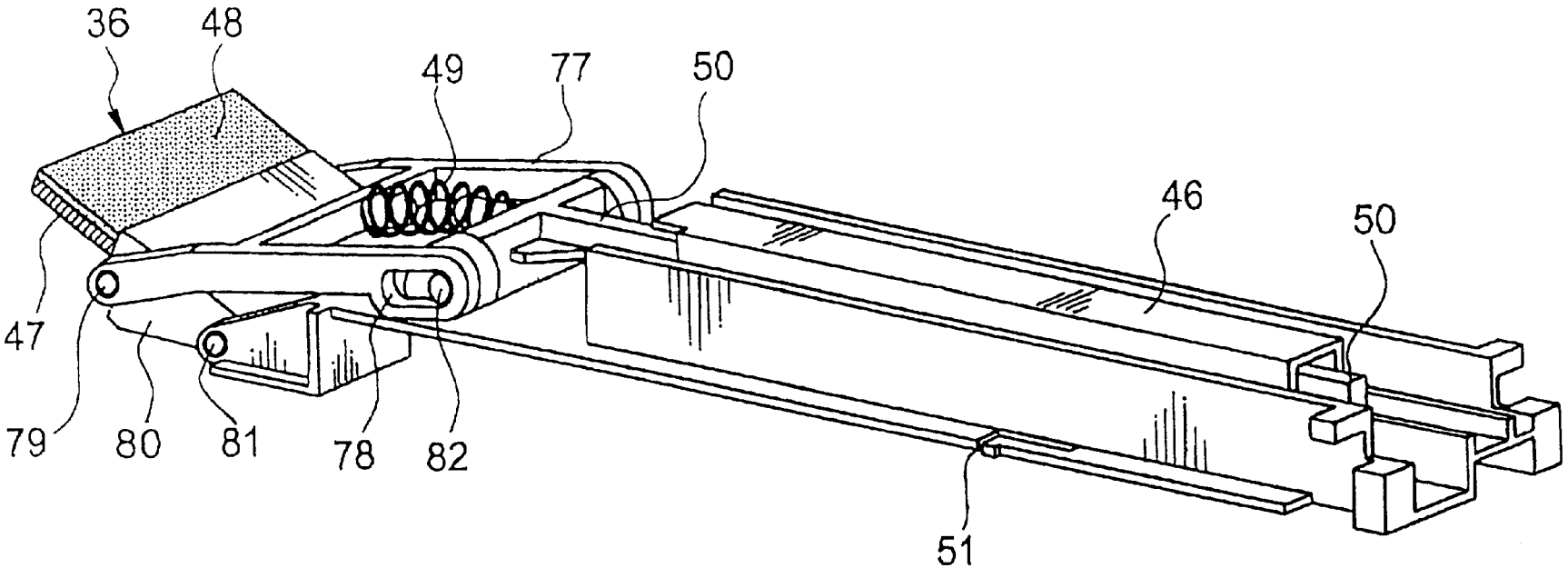
FIG. 7 is a perspective view of the wiping according to the invention to show that the wiping member is tilted.

FIG. 6 is a bottom plan view of the wiping unit 35 when the wiping unit 35 in the state in FIG. 5. The slider 46 is formed with a main rack 85 along the longitudinal direction of the slider 46 and is reciprocated as a pinion 52*a,* 52*b,* 52*c* (see FIG. 9) meshing with the main rack 85 is rotated in forward and backward directions.

The base 50 having the differential rack 86 is further provided so that the wiping unit becomes slidable in the longitudinal direction of the slider 46. The differential rack 86 is reciprocated in step with the main rack 85 as the pinion 52*a,* 52*b,* 52*c* meshing with the differential rack 86 is rotated in the forward or backward directions. The mesh state of the pinion 52*a,* 52*b,* 52*c* with the main rack 85 terminates in the move termination part of the slider 46 in the forth motion direction and after the slider 46 stops, the differential rack 86 still maintains the mesh state with the pinion, 52*a,* 52*b,* 52*c* and only the differential rack 86 is further pushed out and is moved in the forth motion direction.

Specifically, the rack pitches in the main rack 85 and the differential rack 86 we almost the same as shown in FIG. 6 and the number of rack teeth made in the differential rack 86 is greater than that of rack, teeth made in the main rack 85 by three. FIG. 6 shows a state in which the differential rack 86 is not pushed out with respect to the main rack 85, and a tooth 88 positioned at the extreme tip on the side of the differential rack 86 is arranged at the same position as a tooth positioned at the extreme tip on the side of the main rack 85. On the other hand, a tooth 87 positioned at the extreme rear end on the side of the differential rack 86 extends off a tooth positioned at the extreme rear end on the side of the main rack 85 by three pitches backward. Thus, after the slider moves to and stops at the position where the mesh of the tooth at the extreme rear end of the main rack 85 with the opinion is released, the differential rack 86 can be further moved by the distance corresponding to the three teeth at the termination part. As only the differential rack 86 is moved, the wiper 36 is rotated and can be tilted largely in the forth motion direction as shown in FIG. 7.

Figure 8:
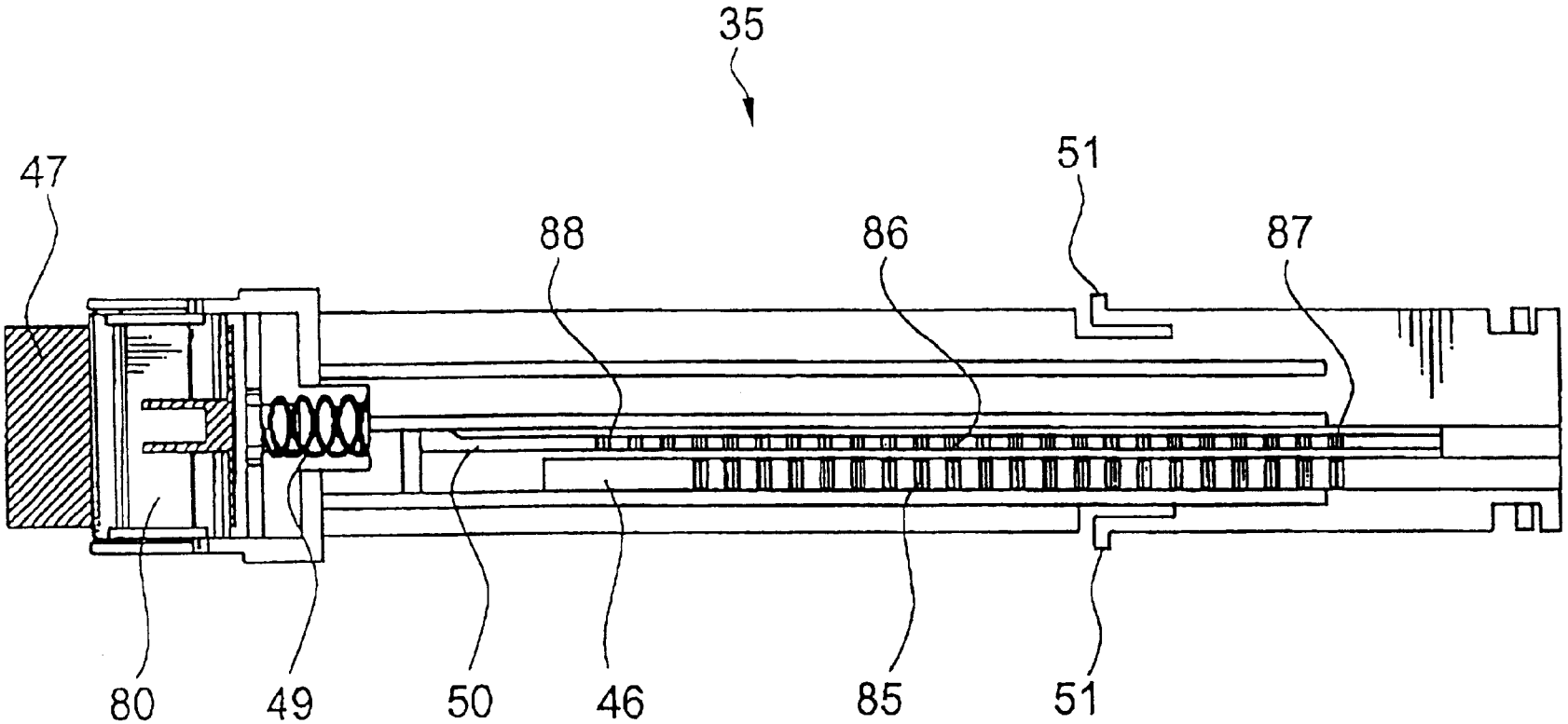
FIG. 8 is a bottom plan view of the wiping unit of FIG. 7.

FIG. 8 is a bottom plan view of the wiping unit of the wiping unit 35 when the wiping unit in the state in FIG. 7. The differential rack 86 is pushed out with respect to the main rack 85 and the tooth 88 positioned at the extreme tip on the side of the differential rack 86 extends off the tooth positioned at the extreme tip on the side of the main rack 85 by three pitches forward. On the other hand, the tooth 87 positioned at the extreme rear end on the side of the differential rack 86 is arranged at the same position as the tooth positioned at the extreme rear end on the side of the main rack 85.

In this state, if the pinion is meshed with the main rack 85 and the differential rack 86 and is rotated backward, the corresponding wiping unit is moved back with the wiper 36 tilted as shown in FIG. 7. After the slider is moved back to and stops at the position where the mesh of the tooth at the extreme tip of the main rack 85 with the opinion is released, the differential rack 86 can be further moved by the distance corresponding to the three teeth extending to the tip end side including the tooth 88 at the extreme tip (FIG. 8). As only the differential rack 86 is moved back, the wiper 36 is rotated in the back motion direction and is restored to the orthogonal state to the slider 46 as shown in FIG. 5.

If the pinion 52*a,* 52*b,* 52*c* meshes with both the racks 85 and 86 in the state shown in FIG. 5, namely, FIG. 6 in the structure in the embodiment wherein the base body 84 to which the shaft body 82 is fixed is fixed to the base body 50 of the differential rack 86, the wiping member is restricted in rotation in the forth motion direction from the orthogonal state. The reason is that as both the racks and the pinion mesh with each other simultaneously, both the racks are moved in one piece and a move of only the differential rack is not made. Therefore, the position becomes the rotation limit in the forth motion direction. This state is used in the rubbing operation.

Figure 9:
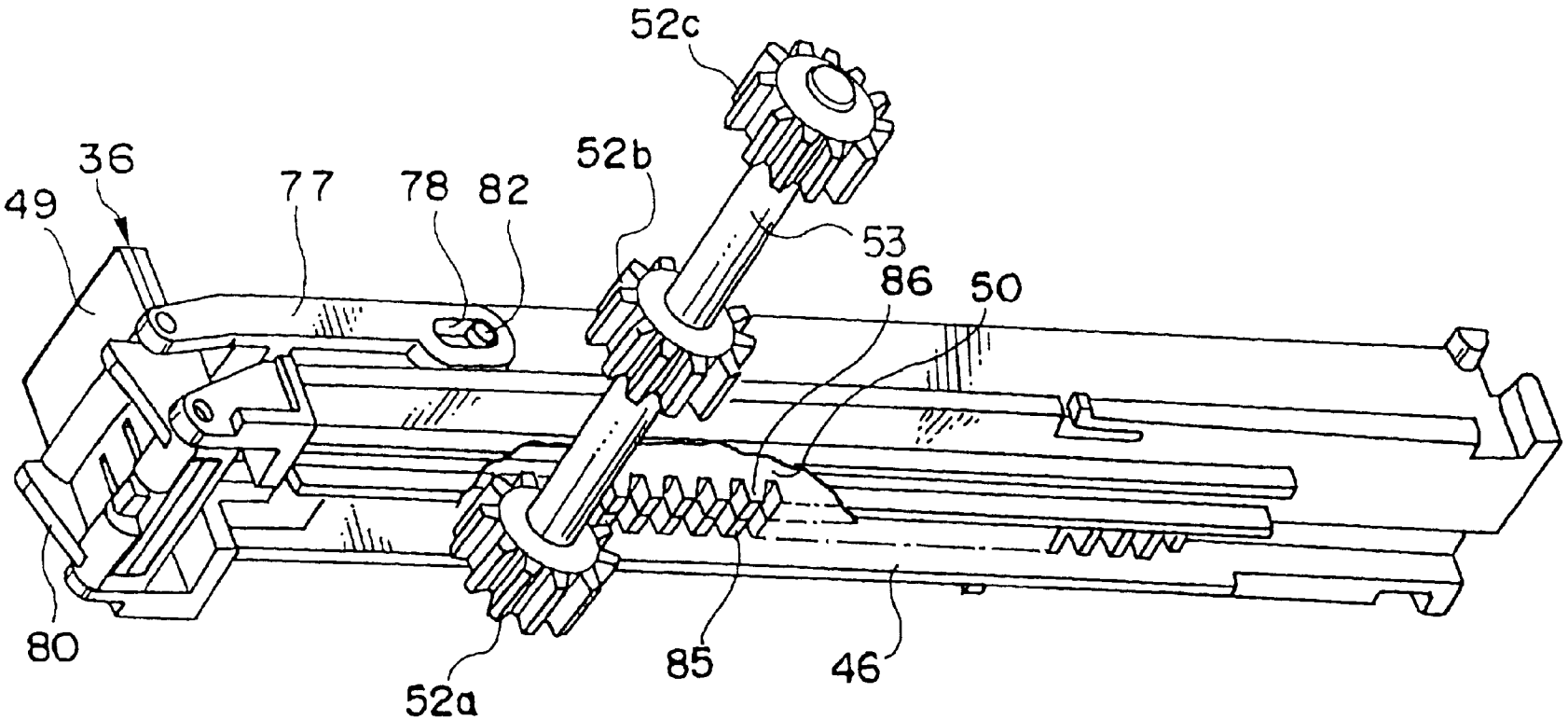
FIG. 9 is a bottom perspective view showing a state wherein the wiping unit meshes with a pinion.

FIG. 9 is a perspective view of the wiping unit 35 when the wiping unit 35 meshing with the pinion is viewed from the bottom. The three pinions 52*a,* 452*b,* and 52*c* are provided in a one to one correspondence with the three wiping units (see FIG. 4).

Next, referring again to FIGS. 3 and 4, the ink remover will be discussed. The ink remover 56 for removing ink from the wiper 36 is placed at a position immediately after the wiping operation range. The ink remover 55 has a front 107 of a shape to allow the wiper 36 to gradually start to come in contact with when the slider 46 is moved in the wiping operation direction and a rear 108 of a shape to allow the wiper 36 to be detached in a stroke after the wiper 36 is bent in an opposite direction to the move direction as it is pressed against the front 107.

Figure 22:
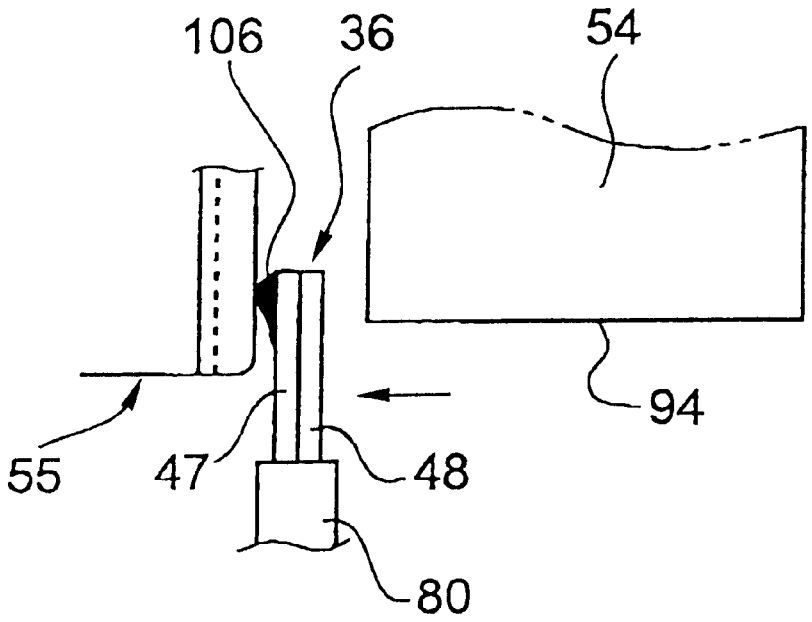
FIG. 22 is a side view of the main part of an ink remover according to the invention.
Figure 23:
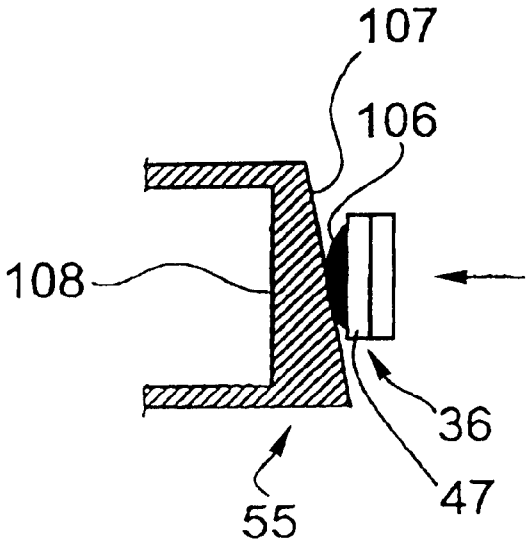
FIG. 23 is a transverse sectional view of the main part of the ink remover according to the invention.
Figure 24:
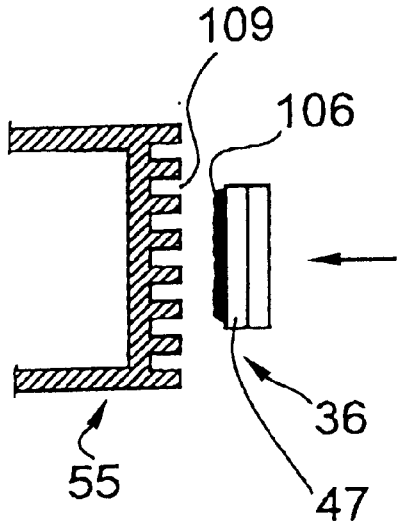
FIG. 24 is a transverse sectional view of the main part of different ink remover according to the invention.
Figure 25:
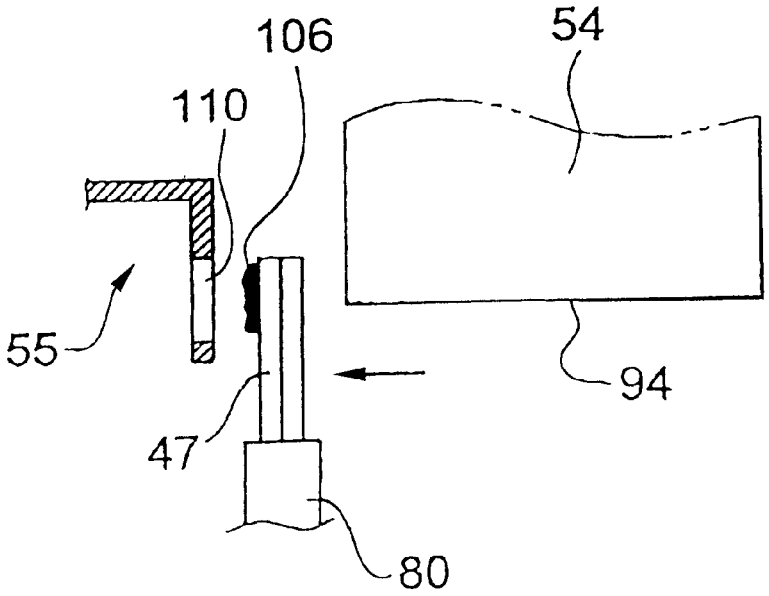
FIG. 25 is a side view of the main part of different ink remover according to the invention.

As the shape of the front 107 of the ink remover 55, a face 109 having a large number of asperities shown in FIG. 24, a face formed with an opening at a position opposed to the end margin of the wiper 36, and the like are named in addition to slopes shown in FIGS. 4, 22, and 23.

In any case, the shape of the rear 108 is made a flat shape orthogonal to the travel direction of the wiper 36.

Since the ink remover 55 removes ink 106 from the wiper 36, the capability of the wiper 36 can be recovered. Preferably, the recovery operation is performed for each wiping operation. The ink remover 55 has the front 107, 109, 110 of the shape to allow the wiper 36 to gradually start to come in contact with. Thus, if the wiper 36 on which the ink 106 is deposited strikes the ink remover 55, scattering of the ink 106 can be decreased. Further, the ink remover 55 has the rear 108 of the shape to allow the wiper 36 to be detached in a stroke after the wiper 36 is bent in the opposite direction to the move direction as it is pressed against the front 107, 109, 110 of the ink remover 55, so that the ink 106 can be splashed from the wiper 36 at the instant at which the wiper 36 is detached, and the capability of the wiper 36 can be recovered reliably.

Further, in the embodiment, as shown in FIGS. 3 and 4, an ink absorber 41 is provided for receiving ink drops splashed from the wiper 36 by the ink remover 55. The ink absorber 41 is held in a holder 40. According to the invention, the ink splashed instantaneously from the wiper 36 can be reliably caught without being leaked to other parts.

Next, the capping unit 37 and the drive mechanism section 200 will be discussed with reference to FIGS. 3, 10, 12, and 21.

First, the capping unit 37 comprises sealing caps 38 on the top of a main body 141 and can be moved to and from the recording head 54 with a pair of left and right guides 142 (FIG. 21) guided on a pair of guide receptacles 39 provided on the side frames 32 and 33. The capping unit 37 also comprises the valve 56 for opening and closing the internal space of the main body 141, and a valve actuator 67 placed in the bottom part of the main body 141 is pulled in a direction away from the bottom of the main body, whereby the valve 56 is changed tom a dosed valve state to an open valve state. The valve actuator 57 is driven by a valve drive cam 62 described later.

The drive mechanism section 200 for controlling moving the capping unit 37 to and from the recording head 54 and opening and closing the valve 56 is made up of a cam body 143 and a subframe 92 swung up and down with the base end as a supporting point by the action of the cam body 143, as shown in FIG. 21.

The cam body 143 comprises a valve drive cam 62 having a short perimeter and a cap drive cam 64 having a long perimeter, the valve drive cam 62 and the cap drive cam 64 placed contiguously in the circumferential direction on an outer peripheral surface 61 of a small-diameter shaft 60 shaped like a cylinder. The valve drive cam 62 and the cap drive cam 64 are shifted in position in the axial direction of the small-diameter shaft 60, as shown in FIG. 21. A convex curved surface 63 to the cap drive cam 64 from the termination positions of the valve drive cam 62 is also a cam face having one function described later. A position on the outer peripheral surface 61 of the small-diameter shaft 60 and just before the valve drive cam 62 is used as a cam control reference position 65 and when the reference position 65 is placed as shown in FIG. 3, the cam body 143 is set to the initial position on control of the cam body 143.

The subframe 92 is attached on a base end 105 to the lower part of the base end of the unit frame 31 shown in FIG. 2 (portion pointed to by an arrow 500) so that it can be swung up and down across both the side frames 32 and 33 with an opposite end side as a free end 140 with the base end 105 as a supporting point. The subframe 92 has the free end 140 urged upward by a long coil spring 42, as shown in FIG. 21.

A cam follower 91 of the cap drive cam 64 is provided at the center of the bottom portion of the subframe 92. The cam follower 91 is formed as a roller structure rotated freely. A lever 66 which has a supporting point 67 at a position to the base end of the bottom portion of the subframe 92 and can be 6 rotated up and down is provided. A cam follower 71 of the valve drive cam 62 is placed at a position adjacent to the cam follower 91 of the lever 66. Further, a hand part 70 is placed at the tip of the lever 66.

The capping unit 37 is coupled at the bottom integrally with a coupling frame 144 provided on the side of the free end 140 of the subframe 92, whereby the capping unit 37 moves in association with swinging of the subframe 92 and is moved to and retracted from the recording head 54. In the couple state, the hand part 70 of the lever 66 is retained in the valve actuator 57 of the capping unit 37 and in this state, the lever 66 is pushed down for making a pull down force act on an actuated part 58 of the valve actuator 57, whereby the valve unit 56 is changed from a closed valve state to an open valve state. Numeral 68 denotes the tip of the lever 66 and the tip 68 is joined to the base end side by a joint part 69 for rotation.

Next, the relationship between the wiping unit 35 and the drive mechanism section 200 will be discussed with reference to FIGS. 3, 14, 21, and 32. The slider 46 of the wiping unit 35 is reciprocated by the rack-pinion mechanism of the pinion 52*a,* 52*b,* 52*c,* the main rack 85, and the differential rack 86, as described above. In the embodiment, the pinion 52*a,* 52*b,* 52*c* is rotated by the drive mechanism section 200.

Figure 14:
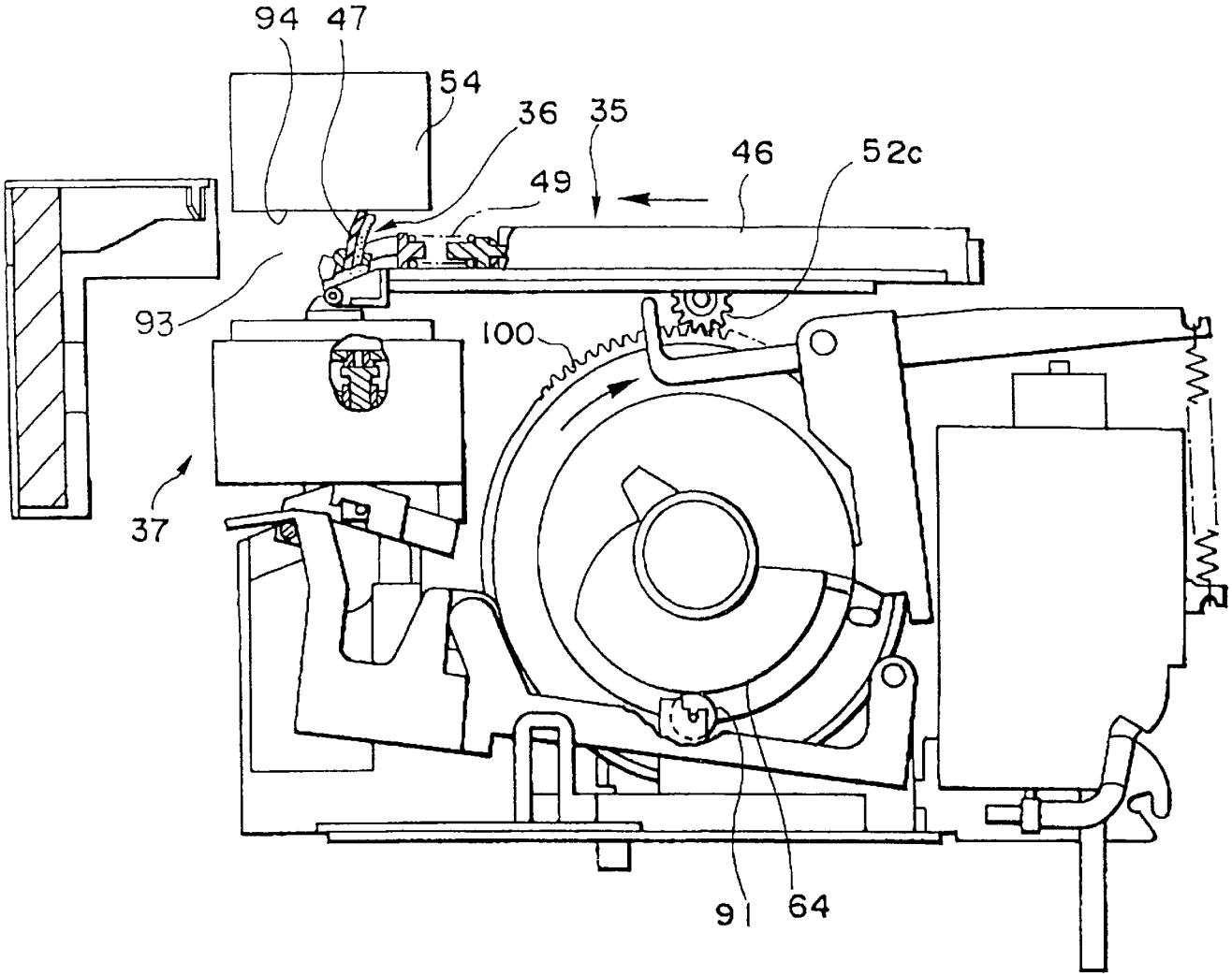
FIG. 14 is a side view of the inside of the same head maintenance unit as in FIG. 13 to show a state in which the cam shaft is further a little rotated.

Rotation power is transmitted to the pinion 52*a,* 52*b,* 52*c* from a drive gear 100 formed in a part on the outer peripheral surface of a drive wheel 101. The drive wheel 101 is attached to the unit frame 31 coaxially with the cam body 143, as shown in FIGS. 3 and 14. Specifically, the cam body 143 shown in FIG. 21 is fitted to a shaft 129 of the drive wheel 101 shown in FIG. 32 in one piece and the cam body 143 and the drive wheel 101 are rotated in one piece around a common shaft with the motor 43 as a drive source.

FIG. 3 shows a state in which the drive gear 100 does not mesh with the pinion 52*a,* 52*b,* 52*c* and FIG. 14 shows a state in which the drive gear 100 meshes with the pinion 52*a,* 52*b,* 52*c.* If the drive wheel 101 is rotated in the state in which the drive gear 100 meshes with the pinion 52*a,* 52*b,* 52*c,* the slider 46 of the wiping unit 35 is reciprocated; if the drive wheel 101 is rotated in the state in which the drive gear 100 does not mesh with the pinion 52*a,* 52*b,* 52*c,* the slider 46 stops.

In the embodiment, as the phase in the rotation direction with both the cam body 143 and the drive wheel 101 in one piece, as shown in FIG. 14, when the subframe 92 is pushed downward by the cap drive cam 64 and the capping unit 37 is retreated from the recording head, the drive gear 100 and the pinion 52*a,* 52*b,* 52*c* are meshed with each other. Therefore, a space 93 produced below the nozzle formation face 94 of the recording head 54 as the capping unit 37 is retreated from the recording head 54 can be used effectively as a space for the wiping operation.

Figure 32:
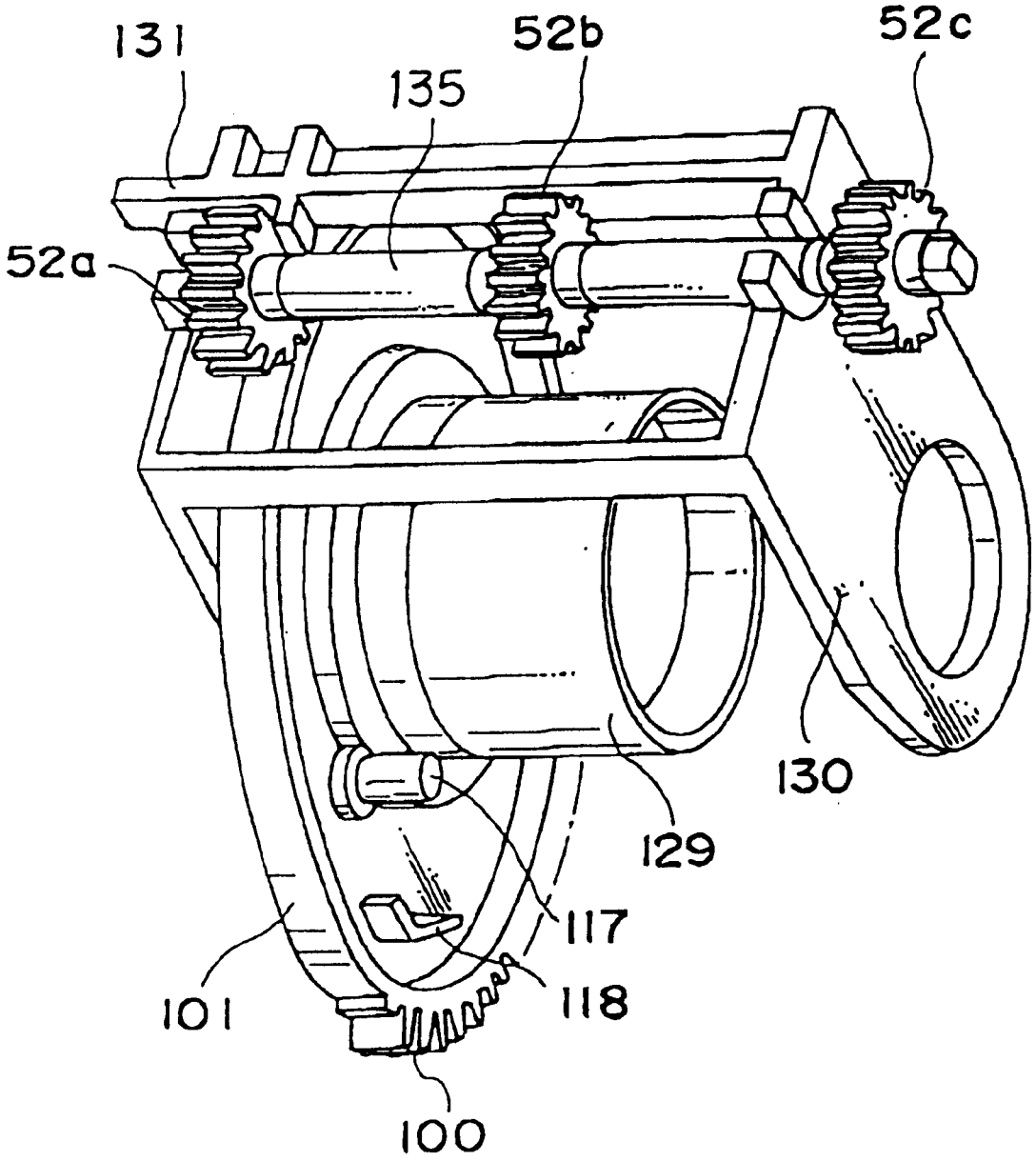
FIG. 32 is a perspective view to show the portion of a drive gear and a pinion according to the invention.

As shown in FIG. 32, the pinions 52*a,* 52*b,* and 52*c* use a common shaft 135 and the shaft 135 is journaled at both ends by the pinion support frame 130, whereby the shaft 135 is supported on the pinion support frame 130 for rotation. Further, the pinion support frame 130 is attached around the common shaft to the cam body 143 and the drive wheel 101 so that it can be pulled and a little rotated by contact friction with rotation of the cam body 143 and the drive wheel 101. The pinion support frame 130 is formed on one side with a projection 131 and the projection 131 is inserted and held in a hole (not shown) made in the side frame 33 with a slight clearance in the rotation direction of the pinion support frame 130.

Therefore, the pinion 52*a,* 52*b,* 52*c* can be moved as the pinion support frame 130 is a little rotated. The reason is as follows: When the pinion 52*a,* 52*b,* 52*c* is meshed with the main rack 85 and the differential rack 86 and is sent in one direction, if it is sent also using the last tooth of the rack, the pinion is detached from the last tooth of the rack at the sending termination time. Therefore, if the pinion is rotated backward, it cannot be meshed with the rack and thus the back motion cannot be made. Then, the pinion is moved a little, so that it can be meshed with the last tooth of the rack, whereby if the pinion is sent also using the last tooth of the rack, the back motion can be made easily.

Next, the wiping operation and the rubbing operation in the ink jet recording apparatus will be discussed with reference to FIGS. 3 and 10 to 20. FIG. 3 shows a state in which the capping unit 37 goes to the recording head 54 and seals the nozzle formation face 94. The drive mechanism section 200 is at the initial position. The drive motor 43 is driven for rotating the cam body 143 and the drive wheel 101 around the command shaft in one piece.

Figure 10:
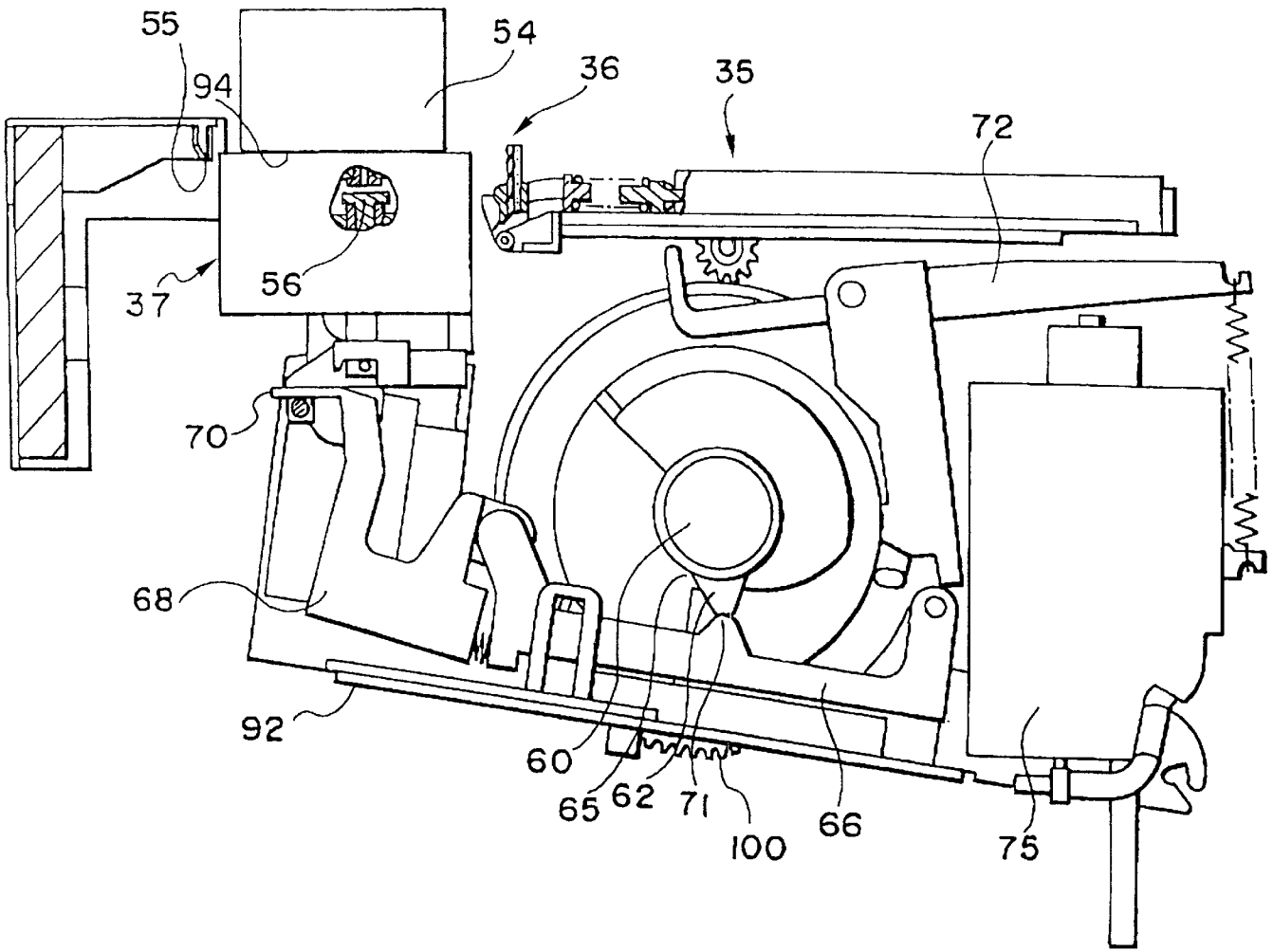
FIG. 10 is a side view of the inside of the same head maintenance unit as in FIG. 3 to show a state in which a cam shaft is a little rotated from a reference position.

FIG. 10 shows the first cam control state in which the cam body 143 is a little rotated from the initial position and the valve drive cam 62 pushes down the lever 66 through the cam follower 71, whereby the valve 56 is changed from a closed state to an opened state. At this time, the subframe 92 does not move and thus the capping unit 37 remains sealing the nozzle formation face 94 of the recording head 54.

Figure 11:
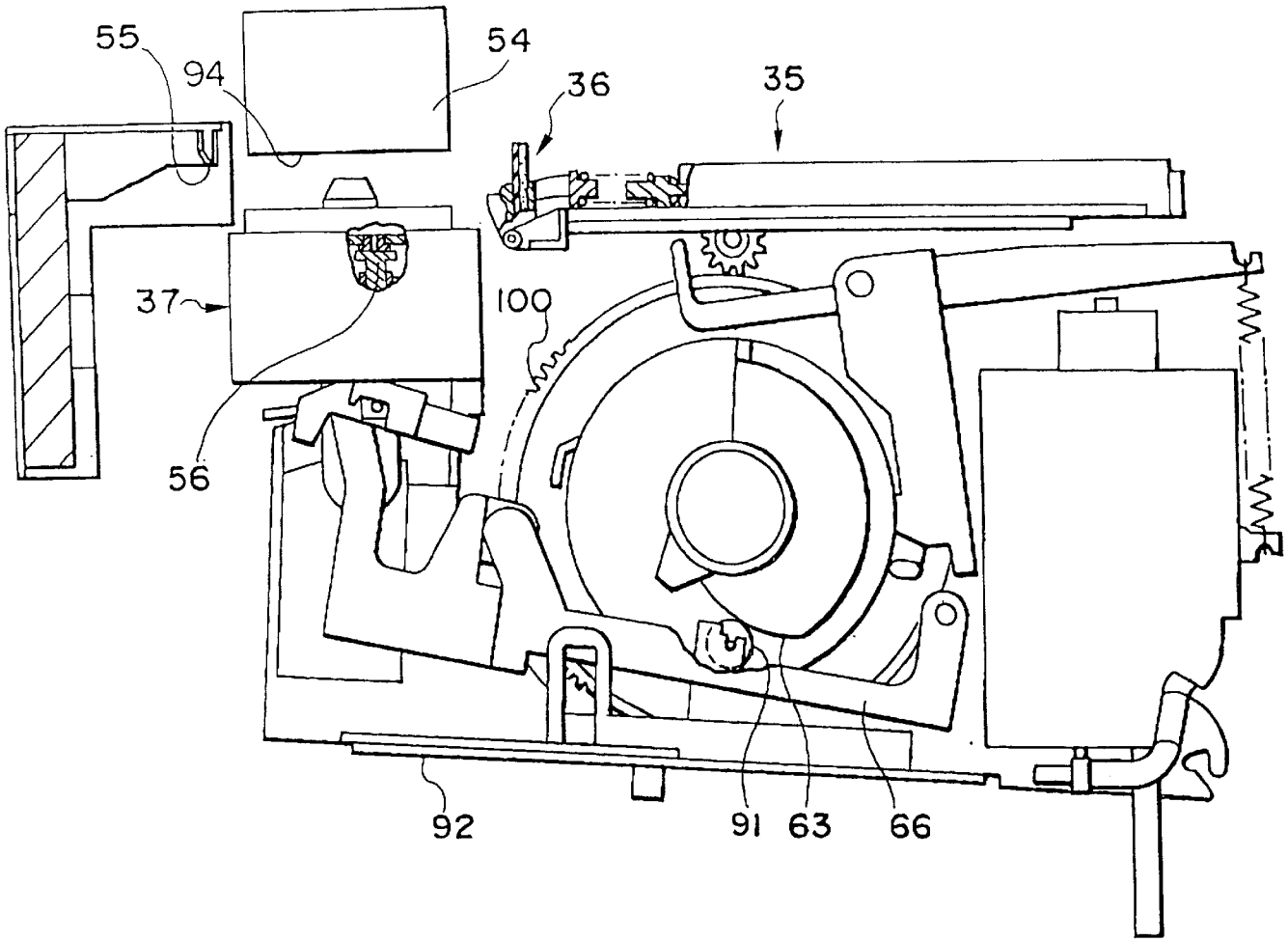
FIG. 11 is a side view of the inside of the same head maintenance unit as in FIG. 10 to show a state in which the cam shaft is further a little rotated.

FIG. 11 shows a state in which the cam body 143 is further a little rotated and the convex curved surface 63 existing before the cap drive cam 64 abuts against the cam follower 91, thereby lowering the subframe 92 a little. Thus, the capping unit 37 comes off the nozzle formation face 94 of the recording head 54. In this state, the record operation is executed in the recording section 2. At this time, the valve drive cam 62 is detached from the cam follower 71 and thus the valve 56 is restored to the closed valve state.

Figure 12:
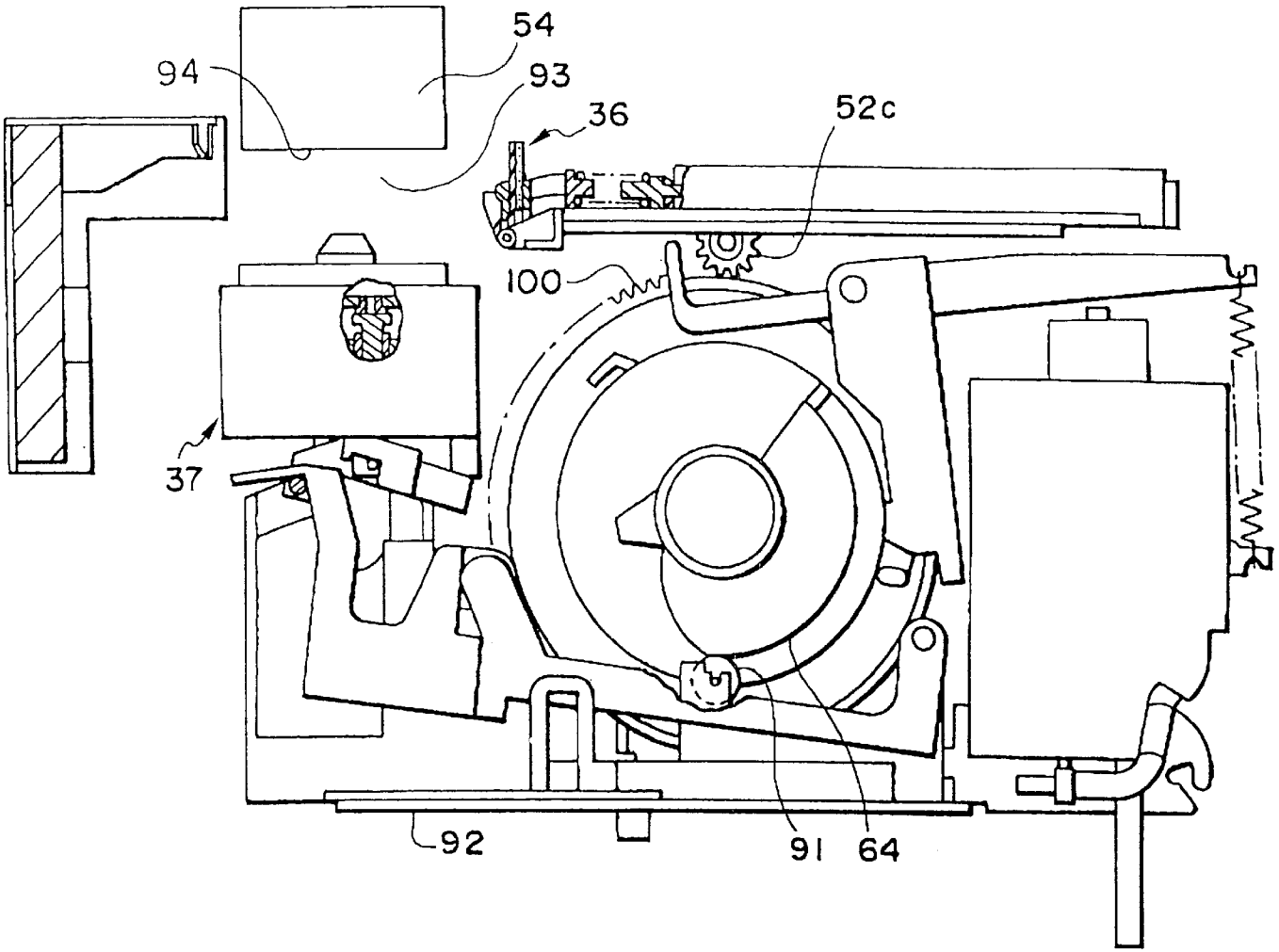
FIG. 12 is a side view of the inside of the same head maintenance unit as in FIG. 11 to show a state in which the cam shaft is further a lime rotated.

FIG. 12 shows a state in which the cam body 143 is further a little rotated and the tip of the cap drive cam 64 abuts the cam follower 91, thereby further lowering the subframe 92. Thus, the capping unit 37 is retreated largely from the recording head 54 and the space 93 that can be used for the wiping operation is produced below the nozzle formation face 94.

Figure 13:
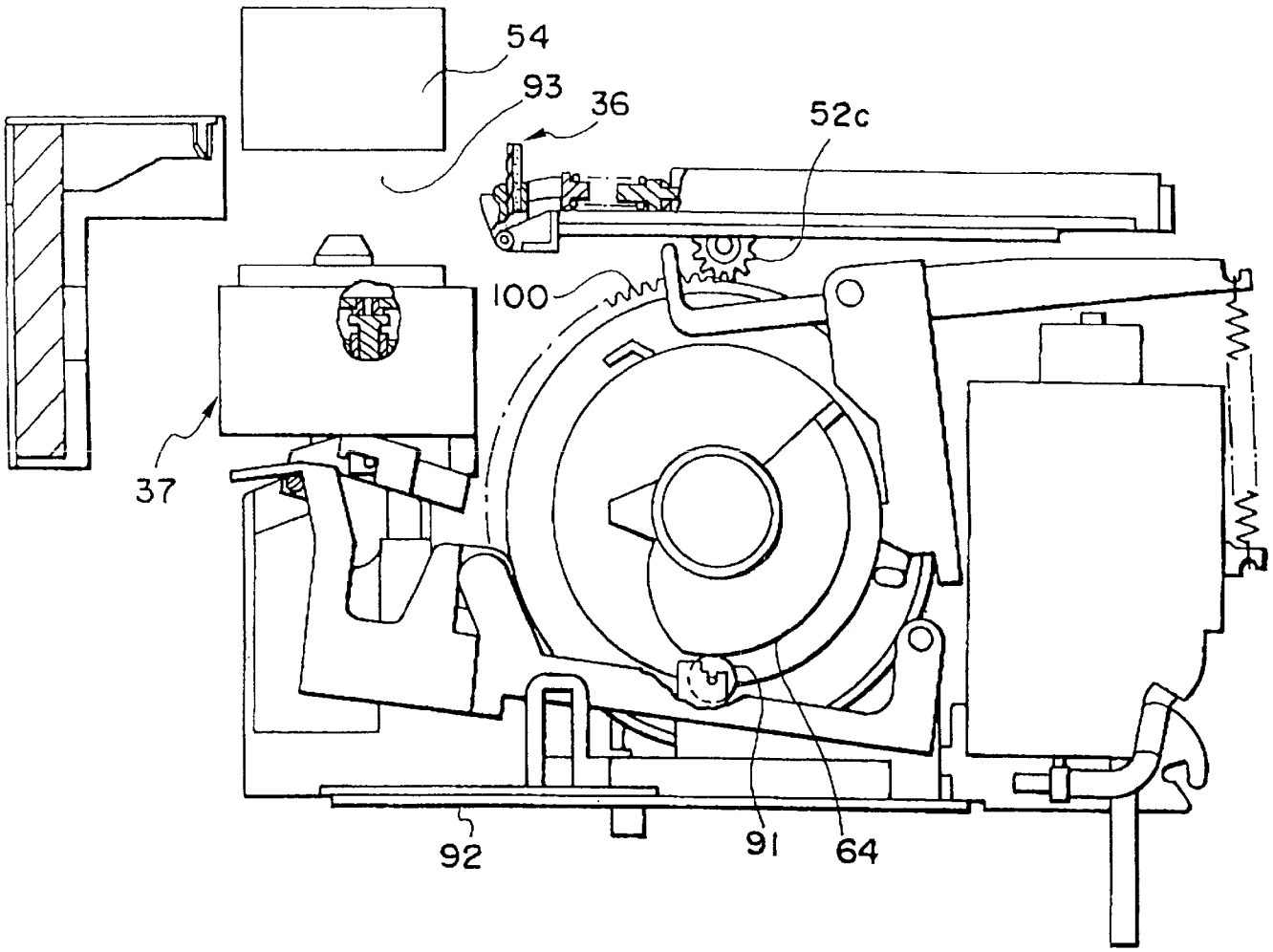
FIG. 13 is a side view of the inside of the same head maintenance unit as in FIG. 12 to show a state in which the cam shaft is further a little rotated.

FIG. 13 shows a state in which the drive gear 100 of the drive wheel 101 starts to mesh with the pinion 52*a,* 52*b,* 52*c* and the slider 46 starts to move in the forth motion direction.

FIG. 14 show a state in which the drive wheel 101 is further rotated, the slider 46 is further moved, and the wiping operation is performed for the nozzle formation face 94 of the recording head 54.

As previously described with reference to FIGS. 5 to 8, the wiper 36 is pressed against the nozzle formation face 94 of the recording head 54 using the elastic forces of both the wiper 36 and the coil spring 49, so that the wiper 36 can be pressed against the nozzle formation face 94 with a soft and appropriate strength to such an extent that a meniscus of ink in the nozzle orifice can be stabilized reliably as compared with the structure in the related art wherein the wiping member is pressed by the elastic force of only the wiping member itself.

Figure 15:
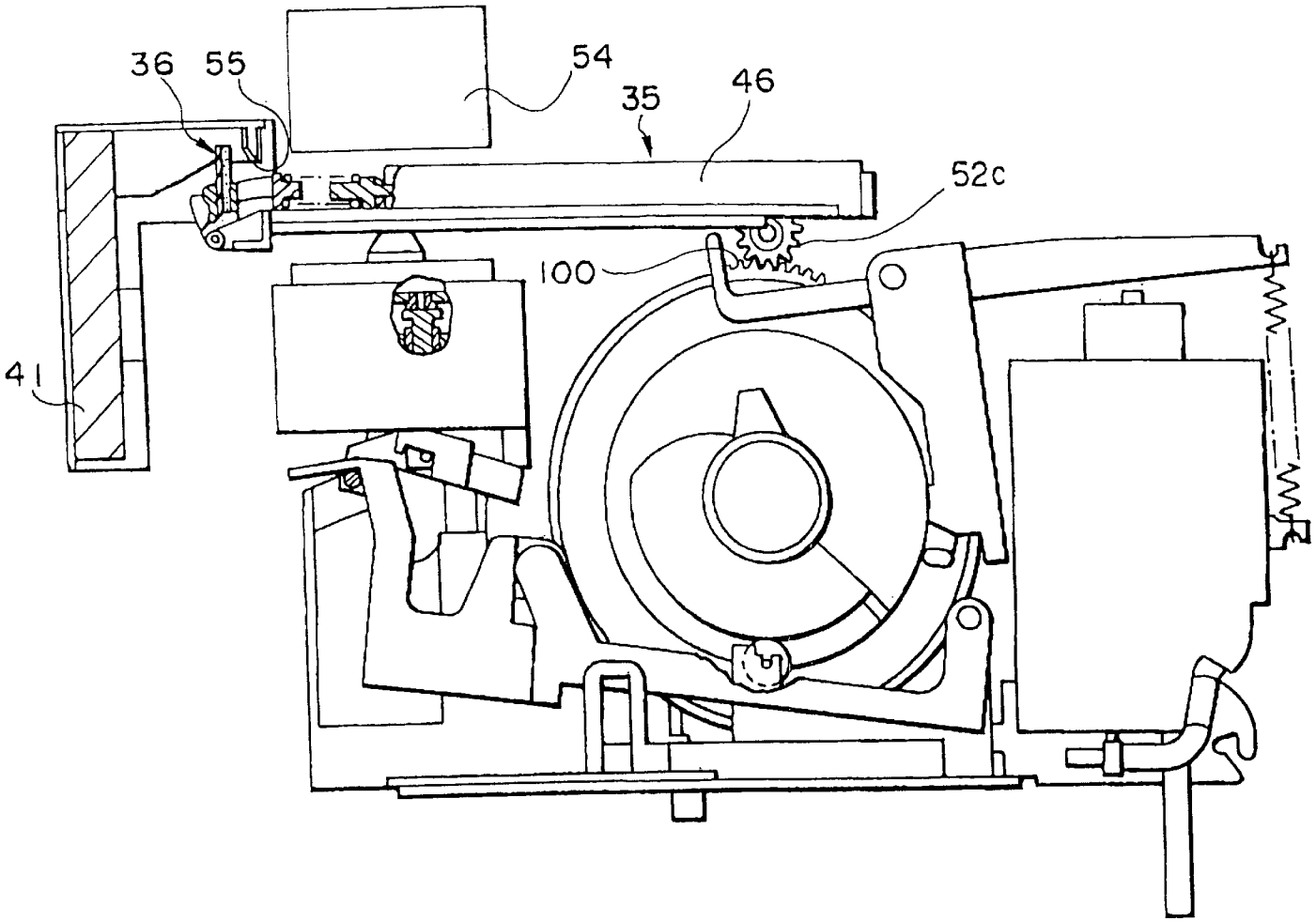
FIG. 15 is a side view of the inside of the same head maintenance unit as in FIG. 14 to show a state in which the cam shaft is further a little rotated.

FIG. 15 shows a state in which the wiping operation terminates and further the capability of the wiper 36 is recovered by the ink remover 55. The capability recovery operation of the wiper 36 executed by the ink remover 55 was previously described with reference to FIGS. 22 to 25.

Figure 16:
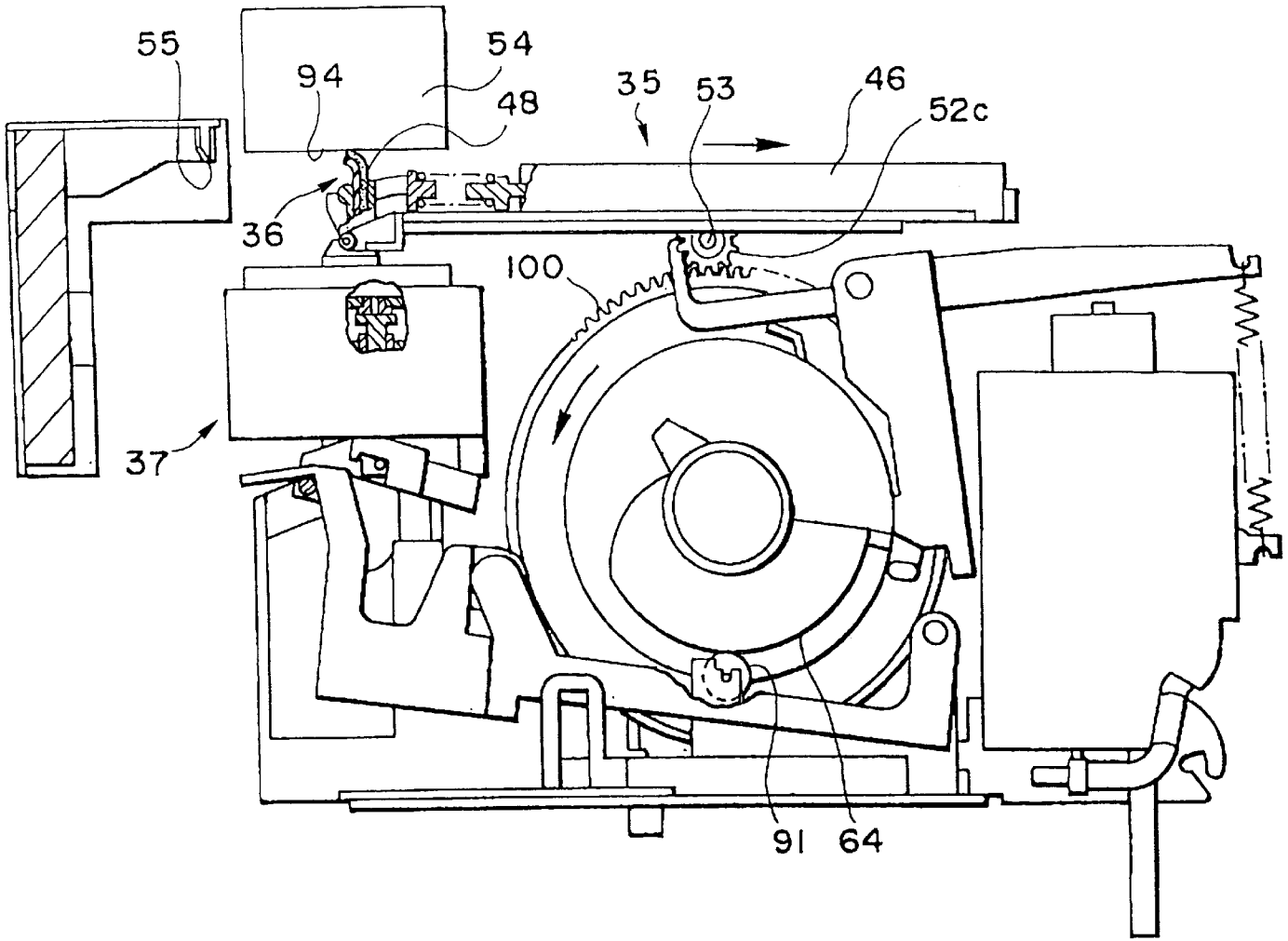
FIG. 16 is a side view of the inside of the same head maintenance unit as in FIG. 15 to show a state in which the cam shaft is a little rotated backward.

FIG. 16 shows a state in which the drive gear 100 is rotated backward from the state shown in FIG. 15 for moving the slider 46 back and the rubbing operation is performed for the nozzle formation face 94.

At this time, as previously described with reference to FIGS. 5 to 8, rotation of the wiper 36 is restricted by the rotation limitter and is supported rigidly, so that the tip margin of the wiping member is strongly pressed against the nozzle formation face 94 in a perpendicular state and the foreign substances fixedly secured to the nozzle formation face 94 can be scraped off reliably. The rubbing operation is not always executed following the wiping operation and can be executed whenever necessary.

Figure 17:
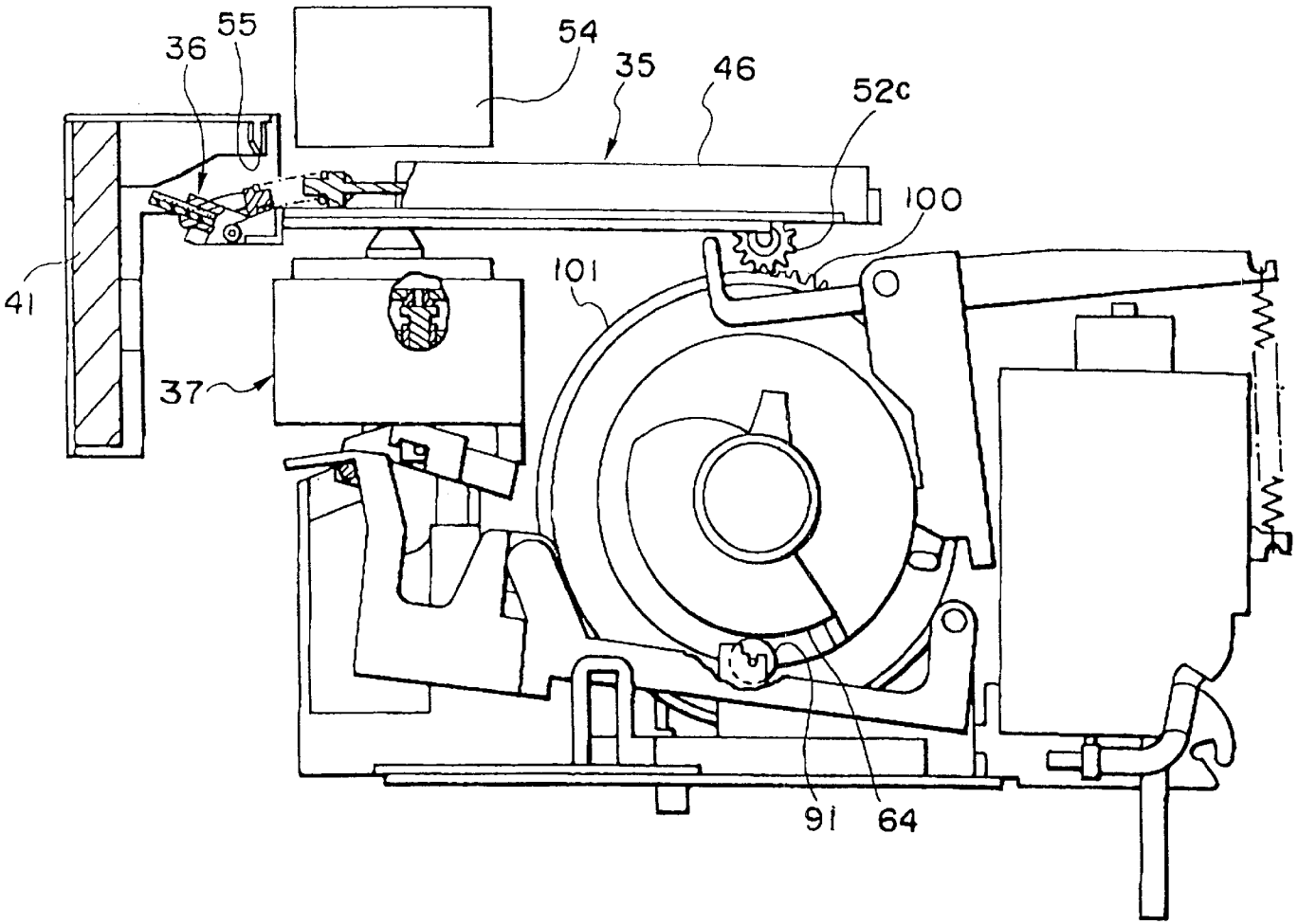
FIG. 17 is a side view of the inside of the same head maintenance unit as in FIG. 15 to show a state in which the cam shaft is rotated to a point near the termination point.

FIG. 17 shows a state in which the drive gear 100 is further rotated forward from the state shown in FIG. 15 and the slider 46 is sent to the position at which the mesh state of the main rack 85 with the pinion terminates, and stops, then only the differential rack 86 is moved forth because of the mesh of the differential rack 86 with the pinion for largely rotating and tilting the wiper 36 in the forth motion direction.

Figure 18:
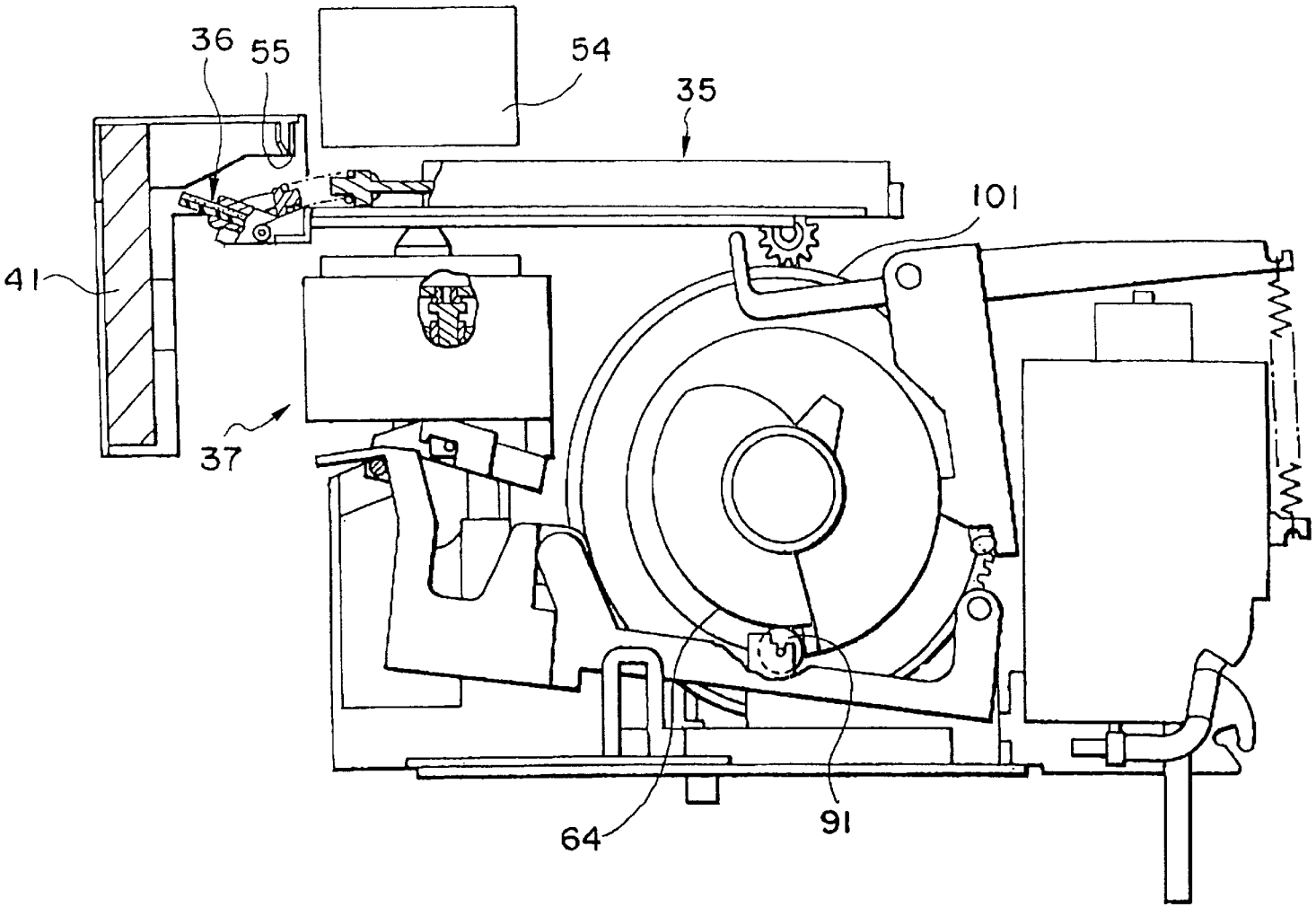
FIG. 18 is a side view of the inside of the same head maintenance unit as in FIG. 17 to show a state in which the cam shaft is rotated to the termination point.

FIG. 18 shows a state in which the drive wheel 101 is further a little rotated forward and a selection cam of the selector 300 (described later) is reset.

Figure 19:
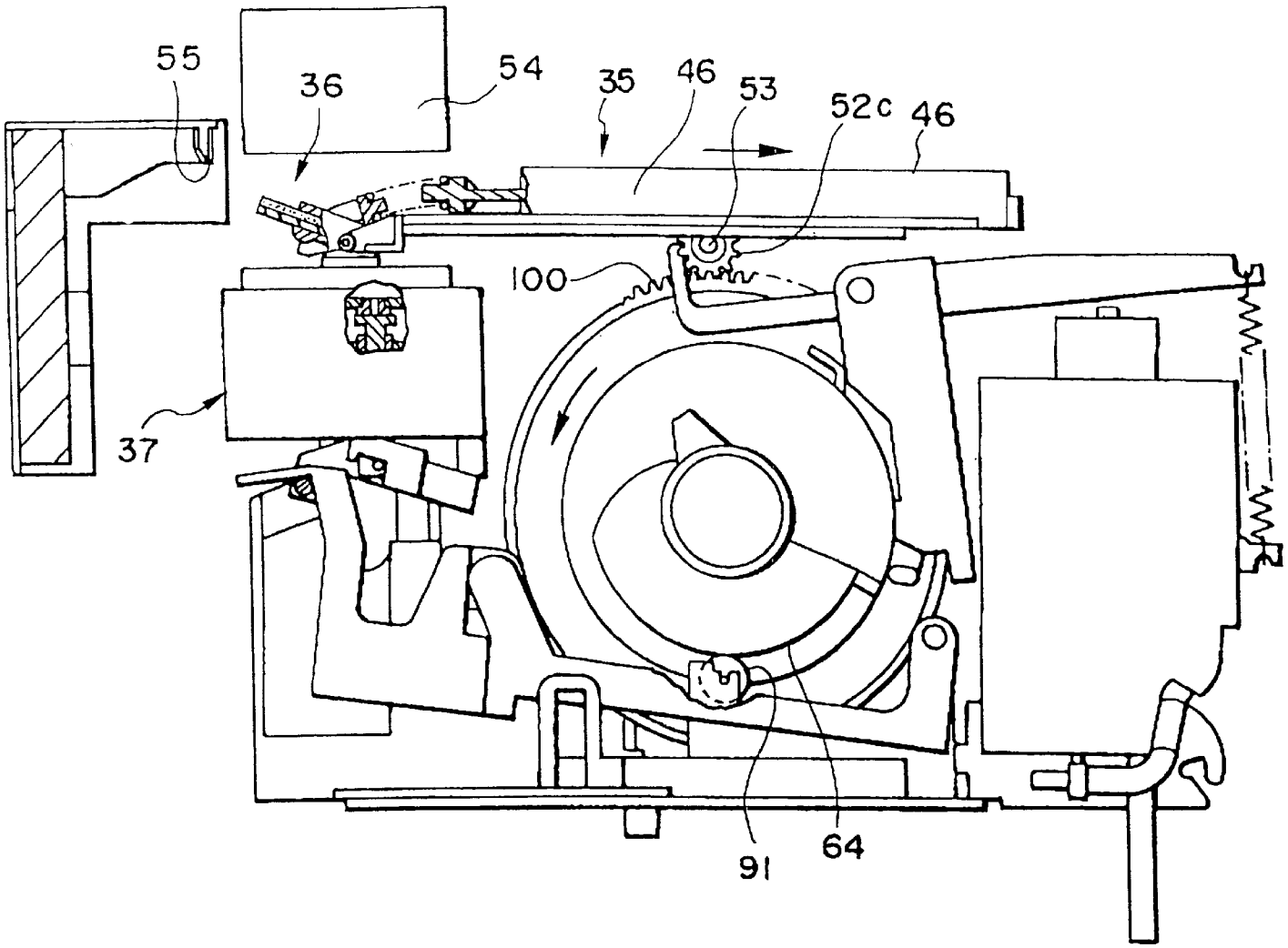
FIG. 19 is a side view of the inside of the same head maintenance unit as in FIG. 18 to show a state in which the cam shaft is a little rotated backward from the state in FIG. 18.

FIG. 19 shows a state in which the drive wheel 101 is rotated backward from the state in FIG. 18 and continues to be rotated backward by meshing the drive gear 100 with the pinion, thereby moving the slider 46 back with the wiper 36 tilted as shown in the figure. The reason why the slider 46 can be moved back with the wiper 36 tilted is that the number of the teeth of the differential rack 86 is made greater than that of the teeth of the main rack 85, as shown in FIGS. 6 and 8. That is, as shown in FIG. 8, if the pinion is rotated backward with the differential rack 86 sent ahead of the main rack 85, both the racks 85 and 86 are sent back together by the common opinion in the relation intact, thus the wiper 36 is moved back as it remains tilted, whereby the wiping operation can be terminated without bringing the wiper 36 into contact with the nozzle formation face 94 where the wiping operation is complete.

Figure 20:
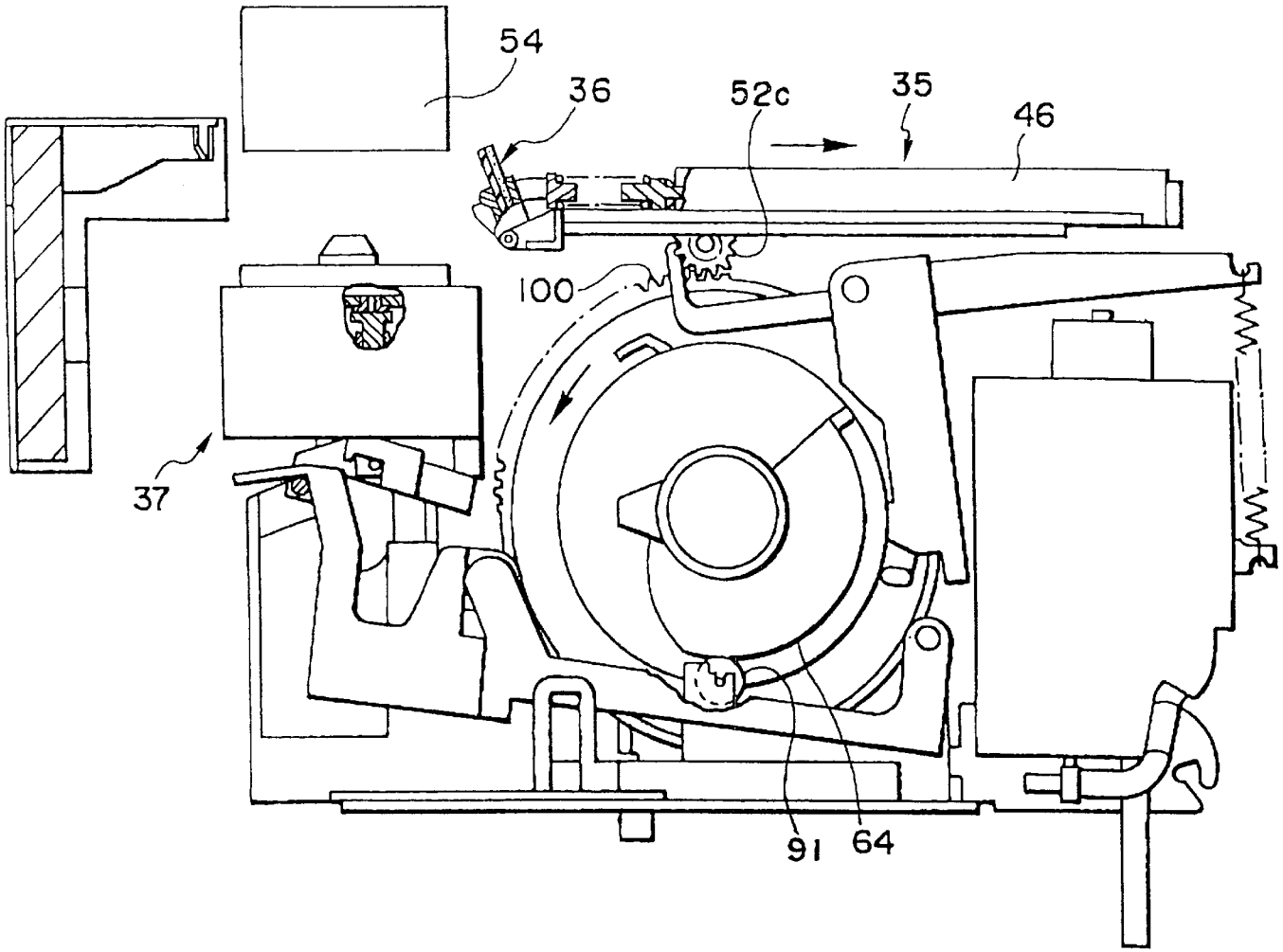
FIG. 20 is a side view of the inside of the same head maintenance unit as in FIG. 19 to show a state in which the cam shaft is further a little rotated backward from the state in FIG. 19.

FIG. 20 shows a state in which the wiper 36 passes through below the recording head 36 and is being restored to the orthogonal state to the slider 46. As shown in FIG. 19, the slider 46 and the differential rack 86 are moved back together, when the slider 46 moves over the distance as much as the full length of the main rack 85 and the mesh of the termination of the main rack 85 with the pinion is terminated, the slider 46 stops moving. At this point in time, however, the differential rack 86 still meshes with the pinion, as seen in FIG. 8. Therefore, only the differential rack 86 continues moving back as the slider 46 stops. As only the differential rack 86 moves back, the tilted wiper 36 rotates with the supporter 81 as the supporting point and is restored to the orthogonal state. When the wiper 36 has been restored to the orthogonal state, the mesh of the tooth 88 at the termination of the differential rack 86 with the pinion terminates and the differential rack 86 stops moving. At this point in time, the mesh state of the drive gear 100 with the pinion also terminates. After this, the drive wheel 101 rotates, but the pinion does not rotate. Since the cam body 143 also rotates integrally with the drive wheel 101, the transition from the state in FIG. 13 to the state in FIG. 10 is made reversing the cam operation previously with reference to FIGS. 10 to 13, and finally a return is made to the initial state shown in FIG. 3.

Next, the relationship between the selector 300 and the drive mechanism section 200 will be discussed with reference to FIGS. 26 to 31, 33 to 36. As already described, in the embodiment, to handle a multicolor heed, the wiping unit 35 comprises three units each consisting of a pair of one wiper 36 and a slider 46 corresponding thereto, as shown in FIG. 4. Since variations in the jetting characteristics of the three wiping units normally are not uniform, the timing at which the wiping operation becomes necessary varies. Therefore, if only the wiping unit having the wiper 36 corresponding to the head part of the nozzle train requiring the wiping operation is reciprocated and others are stopped, waste is eliminated.

The selector 300 can select and drive only the necessary wiping unit; it can be select one to three wiping units to be drive in any combination.

Figure 28:
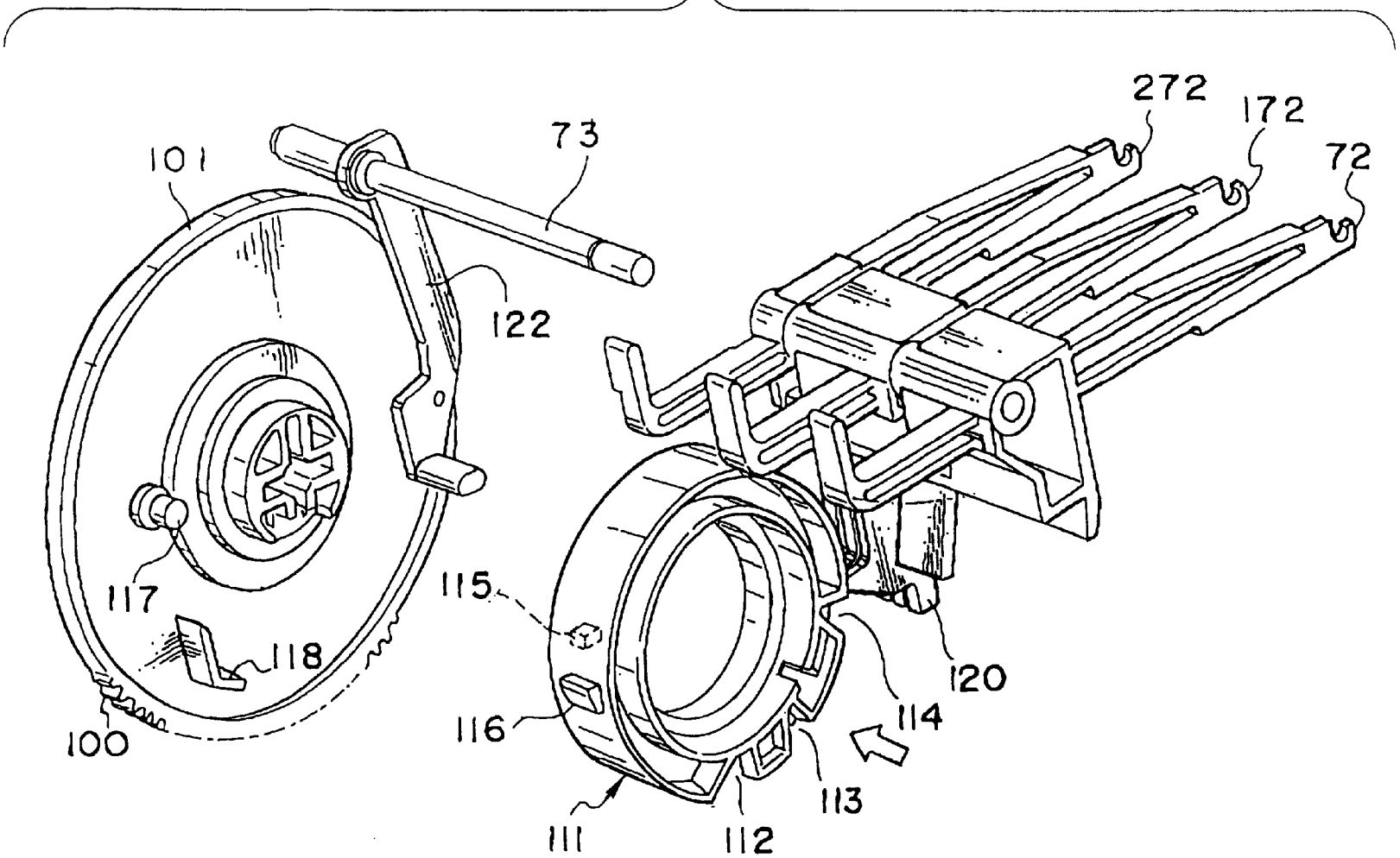
FIG. 28 is an exploded perspective view to show the selector according to the invention.

As shown in FIG. 28, which is an exploded perspective view, the selector 300 comprises the above-described drive wheel 101, a selection cam 111 journaled by the shaft 129 of the drive wheel 101 (FIG. 32), three selection levers 72, 172, and 272 each having a cam follower corresponding to the selection cam 111, and a reset lever 122 for resetting the selection levers 72, 172, and 272. In FIG. 28, the shaft 129 is not shown.

As shown in FIG. 28, the selection cam 111 has a first cam part 126, a second cam part 127, and a third cam part 128 into which the outer peripheral surface shaped like a cylinder is divided functionally in the circumferential direction. As shown in FIG. 28, the first cam part 126 corresponds to the selection lever 72, the second cam part 127 corresponds to the selection lever 172, and the third cam part 128 corresponds to the selection lever 272.

Figure 29:
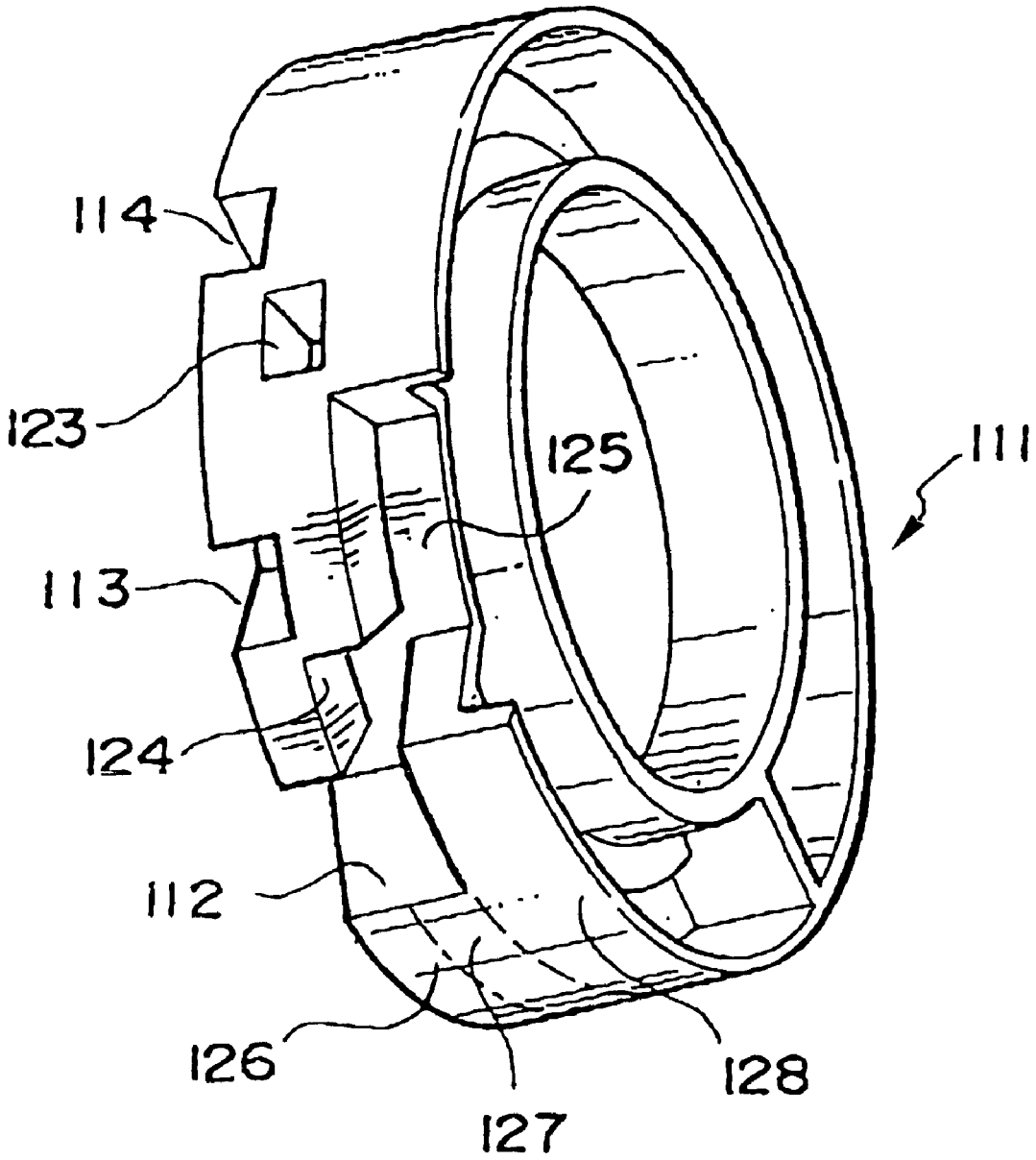
FIG. 29 is a perspective view of selection cam according to the invention viewed from the arrow direction in FIG. 28.

The first cam part 126 has three cam grooves 112, 113, and 114 spaced from each other in the circumferential direction. The second cam part 127 has cam grooves 123 and 124 spaced from each other in the circumferential direction. The third cam part 128 has a cam groove 125. The cam groove 124 is formed on one end side in the circumferential direction partially at the position as the cam groove 112 and is formed on an opposite end side partially at the same position as one end side of the cam groove 125. The center of the cam groove 125 in the circumferential direction is formed at the same position as the cam groove 113 and an opposite end part of the cam groove 125 is formed solely at a different position from other grooves. As shown in FIG. 29, the cam grooves 114 and 123 are also solely at different positions from other grooves. The cam grooves are thus placed, whereby any one of the wiping units can be selected or the wiping units can be selected in any combination with the cam follower (described later) in combination, so that the wiping unit to be driven can be selected whenever necessary.

The selection cam 111 is journaled by the shaft 129 of the drive wheel 101 (FIG. 32), and is disposed between the drive wheel 101 and the cam body 143. In FIG. 3, the selection cam 111 is at a position behind the cam body 143 and is hidden.

As shown in FIG. 28, a rib 115 for retention is projected on the face of the selection cam 111 opposed to the drive wheel 101, and a projection 117 is formed on the drive wheel 101. As the drive wheel 101 is rotated counterclockwise in FIGS. 26 and 28, the projection 117 is retained in the rib 115 of the selection cam 111 and presses the rib 115, whereby the selection cam 111 is rotated together with the drive wheel 101.

A projection 116 for retention is formed on the outer peripheral surface of the selection cam 111. A stopper 119 provided at the tip of an arm (not shown) fixed to the inner face of the side frame 33 is placed at a position shown in FIG. 26. When the selection cam 111 is rotated clockwise in FIG. 26, the projection 116 for retention is retained in the stopper 119 and the selection cam 111 is stopped at the retention position in the stopper 119 in the clockwise rotation.

The cam grooves made in the first cam part 126, the second cam part 127, and the third cam part 128 of the selection cam 111 are shaped so that when the selection cam 111 is rotated counterclockwise, retention parts of cam followers 120, 220, and 320 of the selection levers 72, 172, and 272 (described later) abut and engage the cam grooves and the outer peripheral surface of the selection cam 111 in order to allow the selection cam 111 to be rotated and so that when the selection cam 111 is rotated clockwise, the selection cam 111 is restricted in rotation in a state in which the retention part of each cam follower 120, 220, 320 engages the cam groove. At this time, the selection cam 111 is stopped and only the drive wheel 101 is rotated clockwise.

Figure 26:
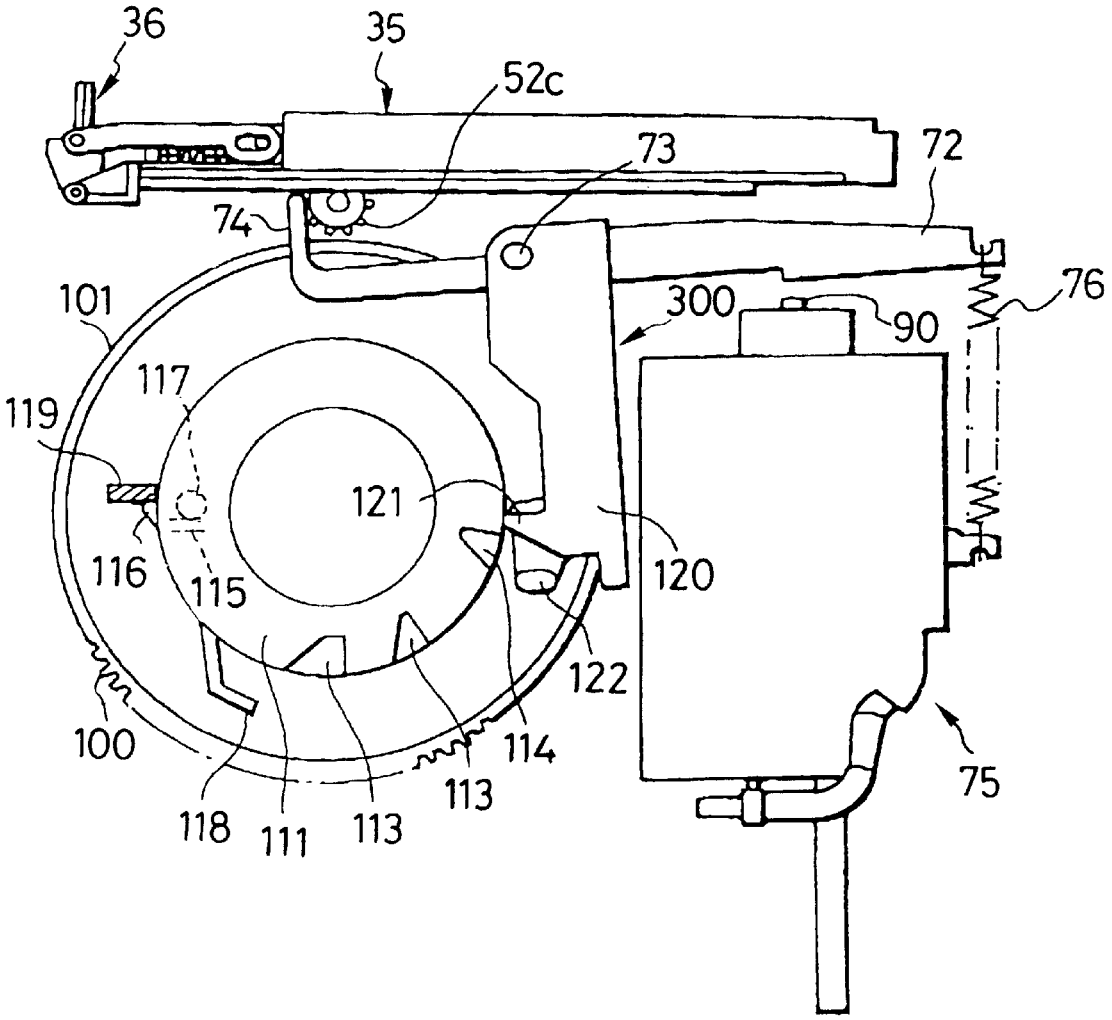
FIG. 26 is a schematic side view to show selector according to the invention.

Further, the selection cam 111 comprises a return spring (not shown) and is assembled in a state in which it receives a clockwise urging force in FIG. 26 by the return spring. Therefore, when the selection cam 111 is released from the restriction force to the rotation position by the rotation force from the projection 117 of the drive wheel 101 and the cam follower of the selection lever 72, 172, 272 (described later), the selection cam 111 is rotated clockwise in FIG. 26 by the spring force of the return spring, the projection 116 for retention is retained in the stopper 119, and the selection cam 111 is held in the state. FIG. 26 shows this state. The state in which the retention projection 116 of the selection cam 111 is retained in the stopper 119 and the projection 117 of the drive wheel 101 is retained in the rib 116 on the selection cam 111 is the reference position on operation control of the selection cam 111, namely, the initial position.

Figure 30:
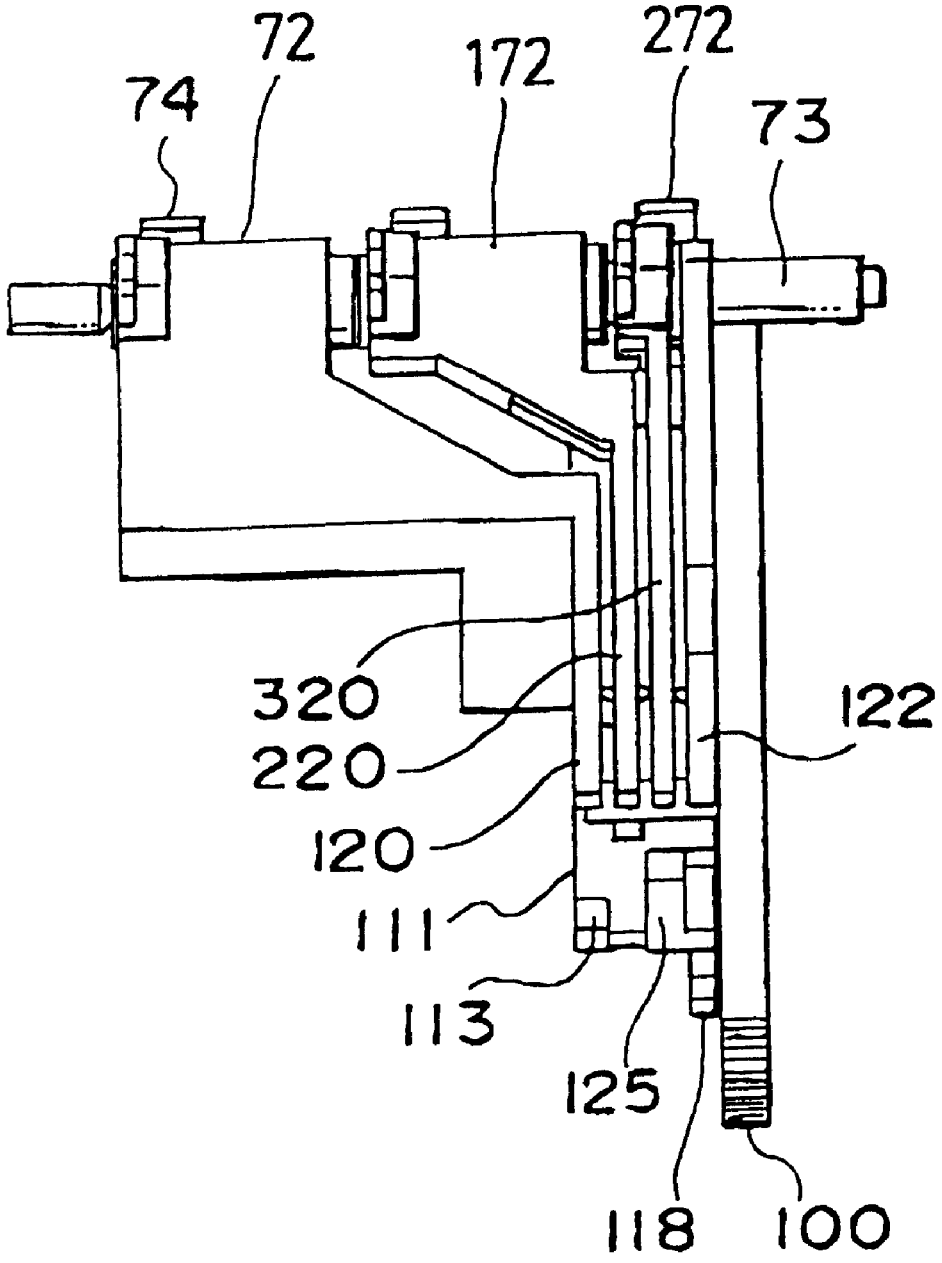
FIG. 30 is a rear view to show the selector according to the invention.

As shown in FIGS. 28 to 30, the selection levers 772, 172, and 272 comprise the first cam follower 120, the second cam follower 220, and the third cam follower 320 engaging the cam grooves of the first cam part 126, the second cam part 127, and the third cam part 128 of the selection cam 111. The selection levers 72, 172, and 272 can be swung around a support point shaft 73 placed on the side frames 32 and 33 and each tip operation part 74 receives an upward force produced by the urging force of a spring 76 placed on the base end side.

FIG. 26 shows a state in which all the retention parts of the first cam follower 120, the second cam follower 220, and the third cam follower 320 of the selection levers 72, 172, and 272 are detached from the cam grooves of the selection cam 111 and abut and engage the uniform outer peripheral surface. This state is a state in which the tip operation part 74 of each of the selection levers 72, 172, and 272 is retreated downward against the urging force of the spring 76. This retreat state corresponds to a state in which the tip operation part 74 does not abut the bottom face of each wiping unit of the wiping unit 35 (in the embodiment, the bottom face of the slider).

Therefore, in this state, the wiper 36 of each wiping unit is lowered to a downward restriction position by a plate spring (not shown), thus the main rack 85 and the differential rack 86 of the wiping unit maintain the mesh state with the pinion 52*a*, 52*b*, 52*c*. This corresponds to a state in which all the three wiping units shown in FIG. 4 are actuated from the viewpoint of the wiping operation.

Figure 27:
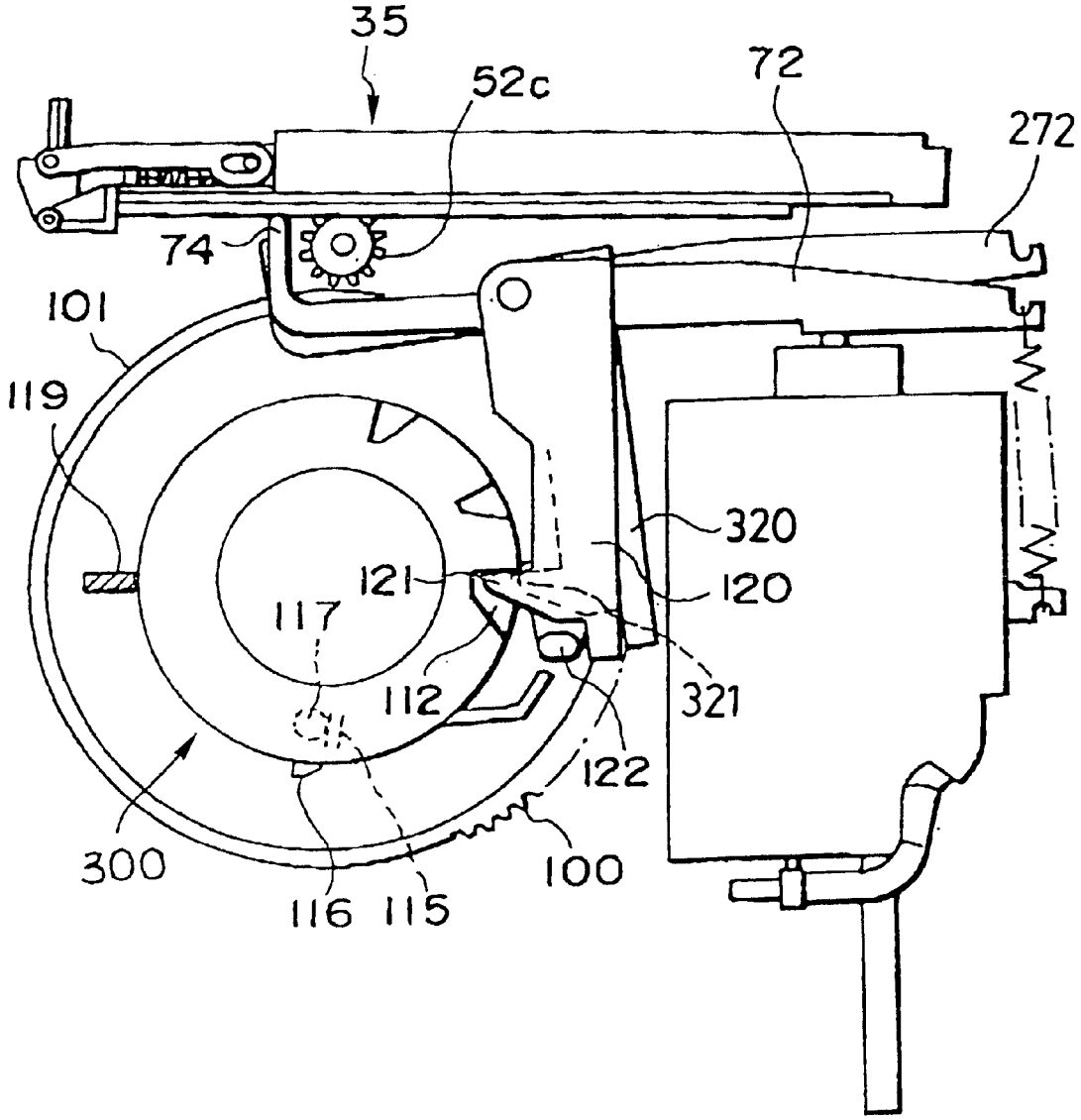
FIG. 27 is a schematic side view the to show a selector according to the invention in a state in which a selection cam is further rotated.

FIG. 27 shows a state in which a retention part 121 of the first cam follower 120 of the selection lever 72 and a retention part of the second cam follower 220 of the selection lever 172 (in FIG. 27, the retention part overlaps the retention part 121 and does not appear) are engaged in the am groove, 112 of the first cam part 126 and the cam groove 124 of the second cam part 127 at the same position as the cam groove 112 at the same time, whereby the tip actuation parts 74 of the selection levers 72 and 172 are advanced upward by the urging forces of the springs 76. The advance distance corresponds to the distance of the retention part 121 entering the cam groove. On the other hand, the selection lever 272 has a retention part 321 engaged on the outer peripheral surface rather than in the cam groove of the selection cam 111, thus the tip operation part 74 corresponding to the selection lever 272 does not abut the bottom face of the corresponding wiping unit as described above.

In this state, the main rack 85 and the differential rack 86 of the wiping unit corresponding to each of the selection levers 72 and 172 do not mesh the pinion 52*a*, 52*b*, thus only the wiping unit corresponding to the selection lever 272 is operated and reciprocated and other wiping units do not operate from the viewpoint of the wiping operation.

The positions of the first cam follower 120, the second cam follower 220, and the third cam follower 320 differ from the relative positions of the selection levers 72, 172, and 272, and are localized side by side to the drive wheel 101, as shown in FIG. 30 The positions of the localized cam followers correspond to the occupation widths of the first cam part 126, the second cam part 127, and the third cam part 128 of the selection cam 111, making it possible to design the width of the selection cam 111 small.

Further, at a position most to the side of the drive wheel 101, the reset lever 122 is placed on the support point shaft 73 formation, as shown in FIG. 30. The reset lever 122 is provided for resetting the selection state of the selection lever 72, 172, 272. In the embodiment, the reset state is the state shown in FIG. 26 in which the first cam follower 120, the second cam follower 220, and the third cam follower 320 are detached from the cam grooves of the selection cam 111 and abut and engage the uniform outer peripheral surface. Therefore, the reset state corresponds to the selection state in which all the three wiping units are actuated from the viewpoint of the wiping operation.

The initial position of the selection operation of the selector 300 is set where the selection cam 111 and the drive wheel 101 are placed in the state shown in FIG. 26, as described above. That is, the state in which the retention projection 116 of the selection cam 111 is retained in the stopper 119 and the projection 117 of the drive wheel 101 is retained in the rib 115 on the selection cam 111 is the initial position on selection operation control of the selection cam 111.

The selector 300 in the initial position state shown in FIG. 26 is fitted to the drive mechanism section 200 with the selection cam 111 positioned behind the cam body 143 of the drive mechanism section 200 in the initial position state shown in FIG. 3. Since the selector 300 is thus fitted to the drive mechanism section 200, if the cam body 143 is rotated in an opposite direction to the forward rotation direction (clockwise) for actuating the valve drive cam 62 and the cap drive cam 64 from the initial position of the cam body 143 shown in FIG. 3, the selection cam 111 is pressed by the projection 117 of the drive wheel 101 and is rotated in association. At this time, the valve drive cam 62 and the cap drive cam 64 do not abut or engage the cam follower 71, 91, so that a non-actuation state is entered.

Therefore, the wiping unit selection operation can be executed by using other portions than the portion of the valve drive cam 62 and the cap drive cam 64 of one cam body 143 with no waste and actuating only the selection cam 111 without actuating the valve drive cam 62 or the cap drive cam 64.

Specifically, the initial position state in FIGS. 3 and 26 is a state in which the three wiping units perform the wiping operation. If the cam body 143 is rotated clockwise in the state, the three wiping units start the wiping operation following the retreat operation of the capping unit 37, etc., as previously described with reference to FIGS. 3 and 10 to 20. On the other hand, if the cam body 143 is first rotated counterclockwise from the initial position state in FIGS. 3 and 26, the selection operation is executed preceding the wiping operation.

After predetermined selection operation is performed by the selection cam 111, the cam body 143 is forward rotated clockwise. At this time, the selection cam 111 is restricted in clockwise rotation by engagement with any one or two of the cam followers 120, 220, and 320 of the selection levers 72, 172, and 272, so that the selection state is maintained. Only the wiping unit thus selected executes the wiping operation.

Figure 31:
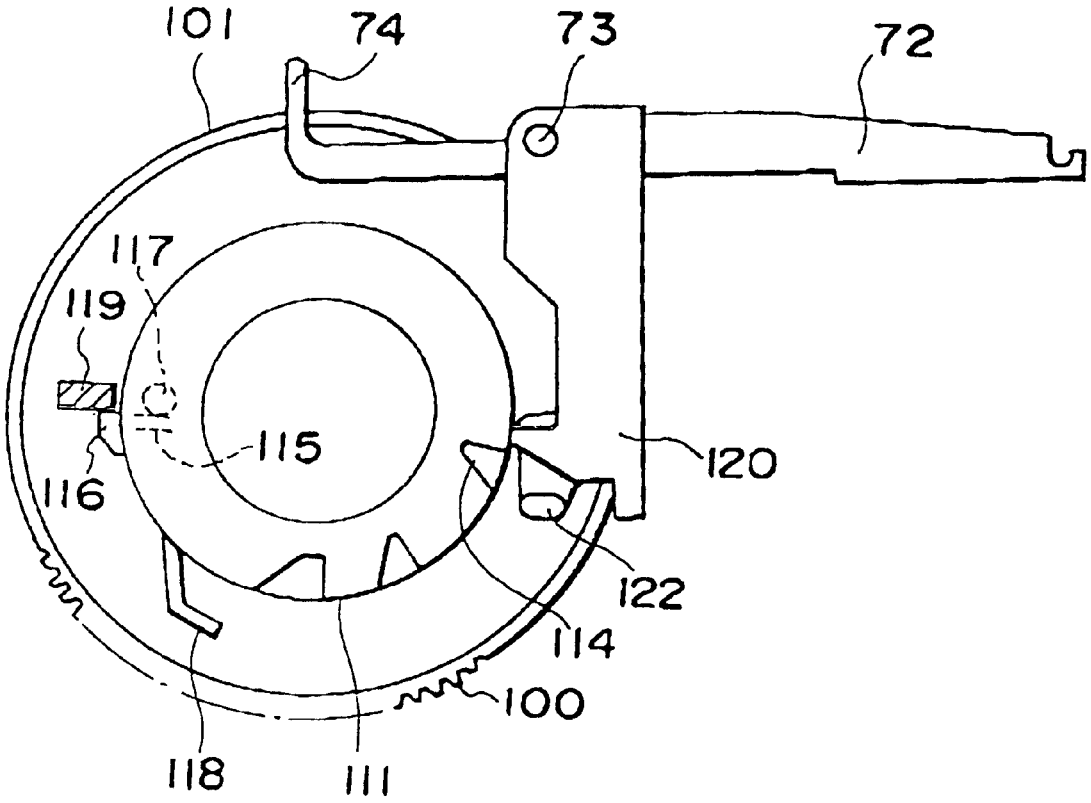
FIG. 31 is a side view of the main part of the selector according to the invention.

Next, the function of the selector 300 will be discussed with reference to FIGS. 31 and 33 to 36. FIG. 31 shows the selector 300 in the same initial position state as in FIG. 26. The selector 300 corresponds to the initial position state for the wiping operation of the cam body 143 shown in FIG. 3 in the relationship with the cam body 143.

If the cam body 143 is rotated counterclockwise in the state, the projection 117 of the drive wheel 101 rotated integrally with the cam body 143 presses the rib 115 on the side of the selection cam 111 for counterclockwise rotating the selection cam 111 against the urging force of the return spring (not shown), whereby any one or two of the cam followers 120, 220, and 320 of the selection levers 72, 172, and 272 previously selected are engaged in the cam grooves of the selection cam 111.

Figure 33:
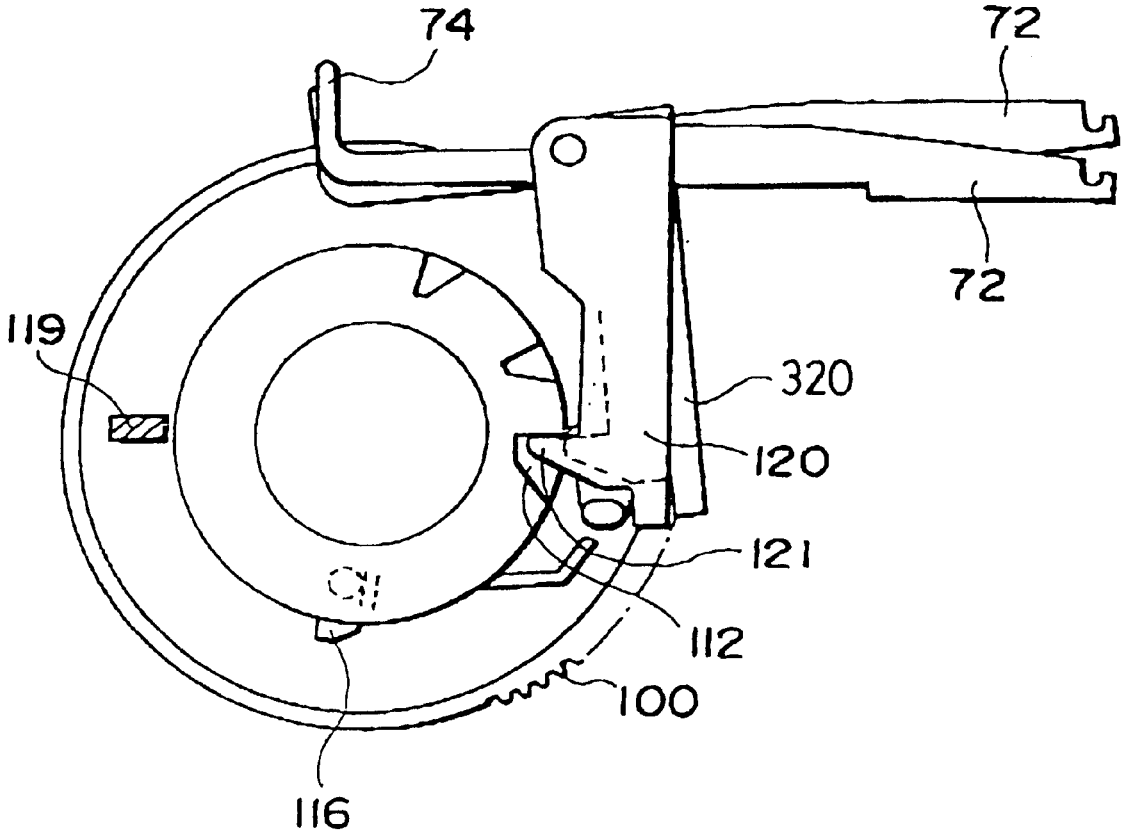
FIG. 33 is a side view of the main part of the selector according to the invention.

FIG. 33 shows a state in which the cam followers 120 and 220 of the selection levers 72 and 172 are engaged in the cam grooves 112 and 124 at the same time and only the cam follower 320 of the selection lever 272 abuts and engages the outer peripheral surface of the selection cam 111. The tip operation parts 74 of the selection levers 72 and 172 rise, pushing up the wipers 36 of the corresponding wiping units 35, whereby the rack-pinion mesh state is released. Thus, if the pinion is rotated, the corresponding wiping unit is placed in a non actuation state.

On the other hand, in FIG. 33, only the wiping unit corresponding to the selection lever 272 having the cam follower 320 not engaging the cam groove of the selection cam 111 executes the wiping operation because the rack-pinion mesh state is maintained.

Figure 34:
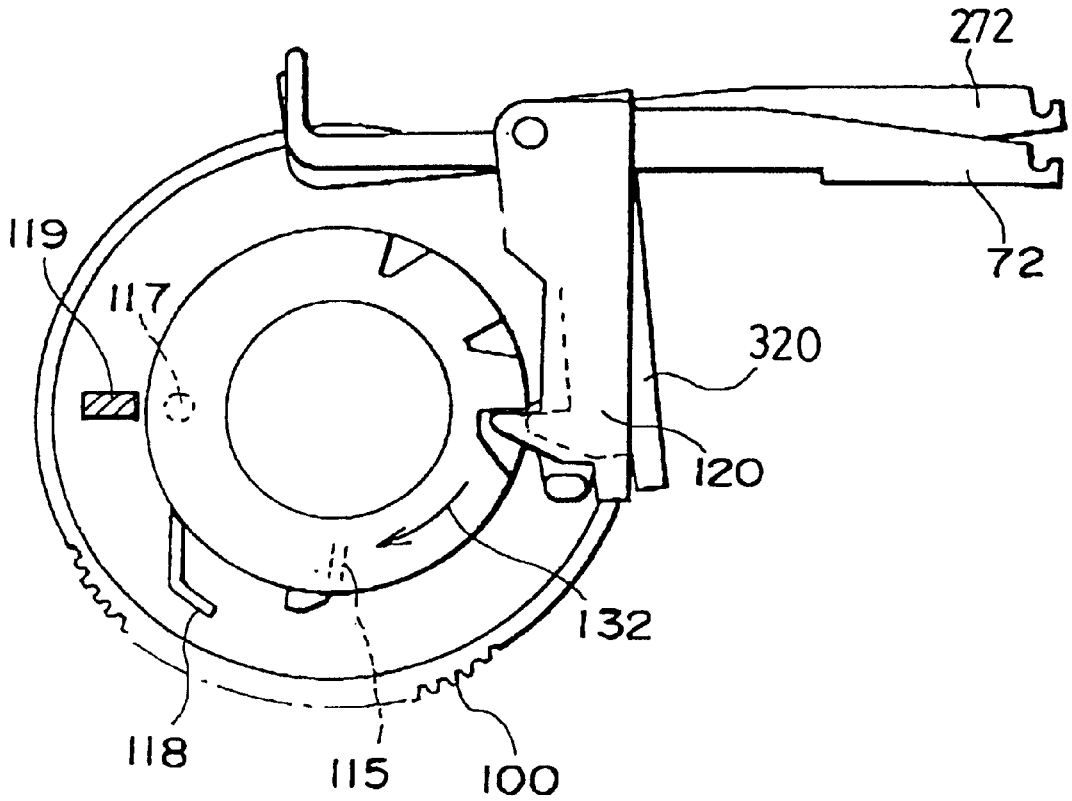
FIG. 34 is a side view of the main part of the selector according to the invention.

Upon completion of the selection operation, the cam body 143 and the drive wheel 101 are rotated clockwise. FIG. 34 shows this state. Thus, the cam body 143 returns to the initial position shown in FIG. 3 and if the cam body 143 is further rotated clockwise, opening/closing the valve 56, the suction operation of the suction pump 75, the retreat operation of the capping unit 37 from the recording head 54, the wiping operation, and the ink removal operation of the ink remover 55 from the wiper 36 are executed and further the rubbing operation is executed as required, as previously described with reference to FIGS. 3 and 10 to 20.

Figure 35:
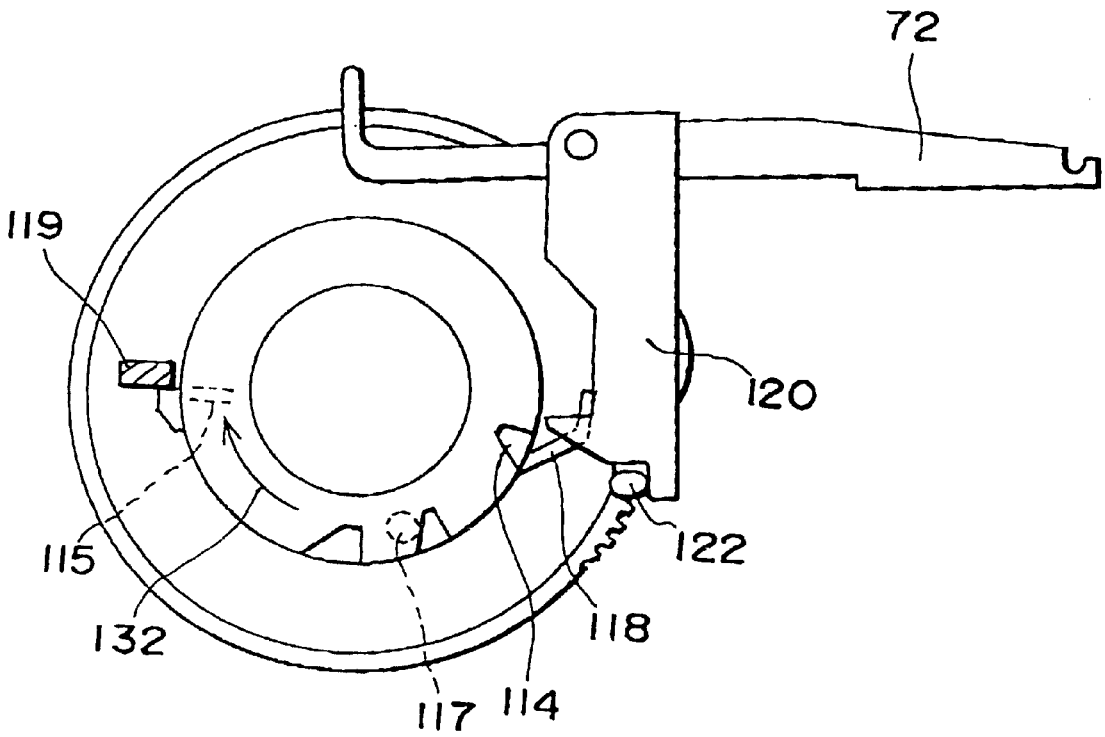
FIG. 35 is a side view of the main part of the selector according to the invention.

In the embodiment, as shown in FIG. 35, the selection lever 72, 172 is reset with the reset lever 122 as follows: The drive wheel 101 is provided with a reset cam 118 as shown in FIG. 28. If the drive wheel 101 is further rotated clockwise together with the cam body 143 from the state shown in FIG. 17 in which the wiping unit is moved forth for performing the wiping operation and the wiper 36 is tilted in the forth motion direction, the reset cam 118 presses and turns the reset lever 122.

As the reset lever 122 is turned by the reset cam 118, the cam follower 120, 220 is released from the retention state in the cam groove, whereby the selection cam 111 has the retention projection 116 returned instantaneously to the position abutting the stopper 119 by an urging force 132 of the return spring (not shown). FIG. 35 shows this state.

Figure 36:
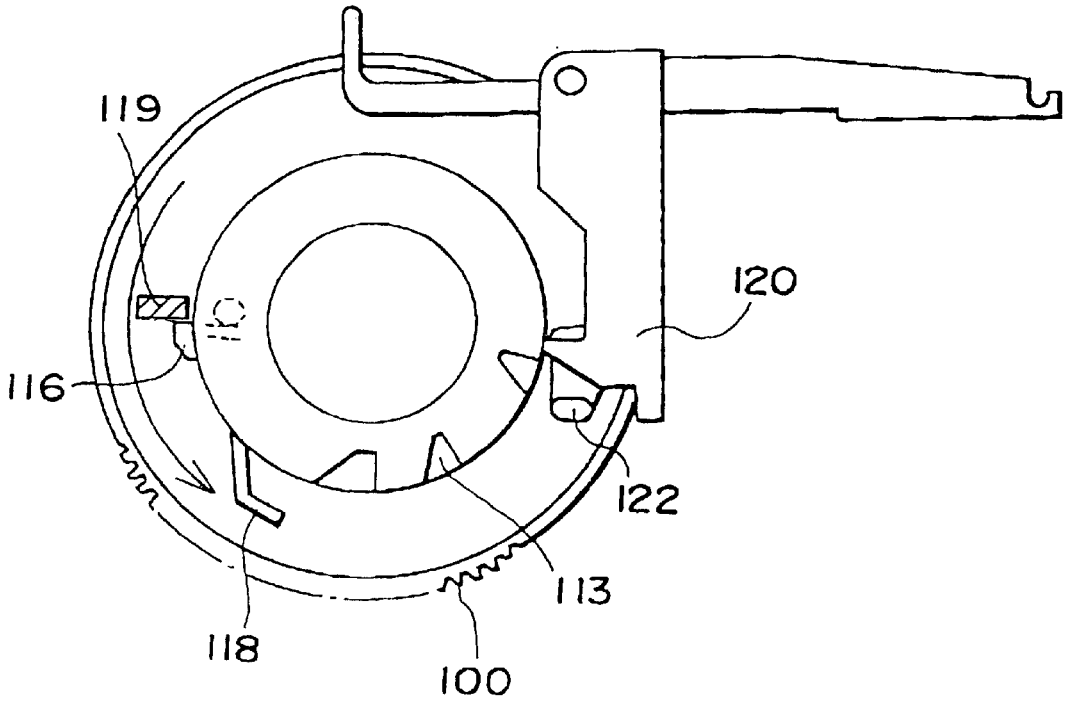
FIG. 36 is a side view of the main part of the selector according to the invention.

After this, the drive wheel 101 is rotated counterclockwise and the projection 117 is abutted against the rib 115 of the selection cam 111 returned to the former position and is stopped. FIG. 36 shows this state. Thus, the drive mechanism section 200 and the selector 300 return to the initial position state shown in FIGS. 3 and 26.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. An ink jet recording apparatus comprising:

a recording head; and a wiping unit for wiping a nozzle formation face of the recording head including:

a slider reciprocally moving in a direction parallel with the nozzle formation face;

a wiper supported by the slider, one end of which is pressed against the nozzle formation face as a wiping operation when the slider moves in a first direction, while as a rubbing operation when the slider moves in a second direction opposed to the first direction;

a supporter for rotatably supporting the other end of the wiper on the slider;

a spring for urging the wiper toward the nozzle formation face while keeping an attitude of the wiper directed by a reaction force generated when the wiping operation is executed; and a rotation limitter for restricting the rotation of the wiper such that the wiper is rigidly supported by the slider when the rubbing operation is executed.

2. The ink jet recording apparatus as set forth in claim 1, wherein the wiper is composite member made of a wiping member which is an elastic plate and a rubbing member made of a material having a higher bending resistance than the wiping member.

3. The ink jet recording apparatus as set forth in claim 2, wherein the wiping unit includes:

a holder for holding the other end of the wiper and rotatably supported by the slider through the supporter; and an arm member one end of which supports the holder, and the other end of which is engaged with the slider with a play of a predetermined stroke for absorbing the elastic force of the spring.

4. The ink jet recording apparatus as set forth in claim 3, wherein the slider has a shaft member fitted into a slot formed at the other end of the arm member so as to be movable within the slot; and wherein the movable range of the shaft member corresponds to the play.

5. The ink jet recording apparatus as set forth in claim 2, wherein the rotation limitter holds the wiper at one rotational limit position to execute the rubbing operation.

6. The ink jet recording apparatus as set forth in claim 2, wherein the slider includes:

a main rack extending in a longitudinal direction of the slider, and a pinion meshed with the main rack and rotating back and forth to reciprocally moving the slider.

7. The ink let recording apparatus as set forth in claim 6, wherein the slider includes a differential rack extending parallel with the main rack and having a first portion and a second portion;

wherein the pinion meshes both of the main rack and the differential rack in the first portion to move the slider cooperationally; and wherein the pinion meshes only the differential rack in the second portion to reciprocally tilting the wiper.

8. The ink jet recording apparatus as set forth in claim 7, wherein pitches of the main rack and the differential rack are substantially the same; and wherein the number of teeth of the differential rack is larger than the number of teeth of the main rack.

9. The ink jet recording apparatus as set forth in claim 7, wherein the wiping unit includes:

a holder for holding the other end of the wiper and rotatably supported by the slider through the supporter; and an arm member one end of which supports the holder, and the other end of which is engaged with the slider with a play of a predetermined stroke for absorbing the elastic force of the spring.

10. The ink jet recording apparatus as set forth in claim 9, wherein the slider has a shaft member fitted into a slot formed at the other end of the arm member so as to be movable within the slot; and wherein the movable range of the shaft member corresponds to the play.

11. The ink jet recording apparatus as set forth in claim 9, wherein the rotation limitter is established by meshing the pinion with the differential rack.

12. The ink jet recording apparatus as set forth in claim 2, further comprising:

an ink remover for removing ink adhered onto the wiper after the wiping operation has been executed, wherein a front face of the ink remover is formed such that the wiper is brought into contact therewith gradually when the slider is moved toward the first direction; and wherein a rear face of the ink remover is formed such that a force for elastically bending the wiper applied by the front face is released and thereby the wiper is restored rapidly.

13. The ink jet recording apparatus as set forth in claim 12, wherein the front face of the ink remover is a slant face.

14. The ink jet recording apparatus as set forth in claim 12, wherein the front face of the ink remover is an uneven face.

15. The ink jet recording apparatus as set forth in claim 12, wherein the front face of the ink remover has an opening formed at a position facing the free end portion of the wiper.

16. The ink jet recording apparatus as set forth in claim 12, further comprising:

an ink absorber for receiving ink removed and splashed from the wiper by the ink remover.

17. The ink jet recording apparatus as set forth in claim 12, further comprising:

a capping unit having a capping state in which the capping unit moves toward the recording head to seal the nozzle formation face and a non-capping state in which the capping unit moves away from the recording head to release the sealing of the nozzle formation face; and a unit frame for retaining the wiping unit and the capping unit, wherein the wiping unit reciprocally moves in a space defined between the recording head and the capping unit in the non-capping state.

18. The ink jet recording apparatus as set forth in claim 17, further comprising:

a cap drive cam for changing a rotational movement thereof into the reciprocal movement of the capping unit between the capping state and the non-capping state;

a main rack extending in a longitudinal direction of the slider;

a pinion meshed with the main rack and rotating back and forth to reciprocally moving the wiping unit;

a drive gear meshed with the pinion to rotate the same; and a shaft member for coaxially supporting the cap drive cam and the drive gear such that the reciprocal movements of the capping unit and the wiping unit are conducted at a predetermined timing.

19. The ink jet recording apparatus as set forth in claim 18, further comprising:

a subframe engaged with a part of the unit frame in a cantilevered manner; and a cam follower, which is to be abutted against the cap drive cam, attached to the subframe, wherein the capping unit is disposed in a free end side of the subframe.

20. The ink jet recording apparatus as set forth in claim 18, further comprising:

a valve drive cam supported by the shaft member coaxially with the drive gear and the cap drive cam, wherein the capping unit includes:

a valve member for opening and dosing an internal space of the capping unit; and an operator for operating the open/close state of the valve member, which is operated by the valve drive cam.

21. The ink jet recording apparatus as set forth in claim 20, wherein the wiping unit indudes a plurality of units arranged parallel with each other, each composed of a pair of slider and a wiper, the recording apparatus further comprising:

a selector for selecting one out of all available combinations of the wiping units to be driven.

22. The ink jet recording apparatus as set forth in claim 21, wherein the moving direction of the slider is parallel with an extending direction of an nozzle array on the nozzle formation face.

23. The ink jet recording apparatus as set forth in claim 22, further comprising:

a passage through which a recording medium is transported to be subjected to the recording by the recording head, the passage extending obliquely from a top part of the apparatus to a bottom part of the apparatus, wherein the moving direction of the slider is parallel with the passage and the first direction directs toward the end of the passage.

24. The ink jet recording apparatus as set forth in claim 21, further comprising:

a select cam supported by the shaft member coaxially with the drive gear, the cap drive cam and the valve drive cam, wherein the selector is cooperated with the select cam to execute the selecting operation when the select cam is moved in a first direction which is opposed to a second direction in which the cap drive cam and the valve drive cam operates the capping member and the valve member respectively; and wherein the shaft member is rotated in the second direction after the selecting operation has been conducted to drive the selected wiping unit.

25. The ink jet recording apparatus as set forth in claim 18, further comprising:

a suction pump for applying negative pressure in the internal space of the capping unit, and provided in the unit frame to constitute a head cleaning unit together with the wiping unit and the capping unit.

* * * * *